US011712105B2

(12) United States Patent
Valvano et al.

(10) Patent No.: US 11,712,105 B2
(45) Date of Patent: Aug. 1, 2023

(54) BACKPACK WITH AIRFLOW SYSTEM

(71) Applicant: Chrome Industries, Inc., Portland, OR (US)

(72) Inventors: Michael Valvano, Boulder, CO (US); Peter Hill, Garibaldi Highlands (CA); Wendy Lai, New Taipei (TW); Michael Leoniak, Milwaukie, OR (US)

(73) Assignee: Chrome Industries, Inc., Portland, OR (US)

( * ) Notice: Subject to any disclaimer, the term of this patent is extended or adjusted under 35 U.S.C. 154(b) by 0 days.

(21) Appl. No.: 17/654,966

(22) Filed: Mar. 15, 2022

(65) Prior Publication Data

US 2022/0192348 A1 Jun. 23, 2022

Related U.S. Application Data

(63) Continuation of application No. 16/719,752, filed on Dec. 18, 2019, now Pat. No. 11,337,509.

(60) Provisional application No. 62/783,082, filed on Dec. 20, 2018.

(51) Int. Cl.
*A45F 3/04* (2006.01)
*A45F 3/00* (2006.01)

(52) U.S. Cl.
CPC ..... *A45F 3/04* (2013.01); *A45F 2003/003* (2013.01)

(58) Field of Classification Search
CPC ..... A45F 3/04
USPC ..... 224/576
See application file for complete search history.

(56) References Cited

U.S. PATENT DOCUMENTS

| | | | | |
|---|---|---|---|---|
| 4,088,252 | A * | 5/1978 | Grunberger | A45F 3/042 D3/217 |
| 4,830,245 | A * | 5/1989 | Arakaki | F41H 5/08 2/2.5 |
| 5,361,955 | A * | 11/1994 | Gregory | A45F 3/047 224/907 |
| 5,573,155 | A | 11/1996 | Sadler | |
| 5,911,348 | A | 6/1999 | Shook | |
| 6,325,262 | B1 | 12/2001 | Thompson | |
| 6,685,072 | B2 | 2/2004 | Ho | |
| 8,925,774 | B2 | 1/2015 | Mori et al. | |
| 2002/0158097 | A1 | 10/2002 | Beale | |
| 2004/0134955 | A1* | 7/2004 | Williams | A45F 3/04 224/644 |
| 2004/0173656 | A1* | 9/2004 | Seong | A45F 3/04 224/644 |
| 2005/0017041 | A1* | 1/2005 | Roberts | A45F 3/04 224/642 |
| 2005/0040684 | A1* | 2/2005 | Yoshiguchi | A45F 3/12 297/228.13 |
| 2005/0138717 | A1* | 6/2005 | Le Gal | A45F 3/04 2/102 |
| 2007/0075109 | A1 | 4/2007 | McCrae | |

(Continued)

FOREIGN PATENT DOCUMENTS

JP 2001204547 A 7/2001

*Primary Examiner* — Nathan J Newhouse
*Assistant Examiner* — Lester L Vanterpool
(74) *Attorney, Agent, or Firm* — McCoy Russell LLP

(57) ABSTRACT

A backpack includes a back panel having an airflow system. The airflow system includes protrusions extending from a base of the back panel and defining boundaries of lateral and vertical flow channels. The flow channels are configured to promote active airflow through the back panel.

14 Claims, 15 Drawing Sheets

(56) References Cited

U.S. PATENT DOCUMENTS

| | | | | |
|---|---|---|---|---|
| 2008/0121674 | A1* | 5/2008 | Yang | A45F 3/04 224/644 |
| 2008/0237288 | A1 | 10/2008 | Hamilton | |
| 2009/0184014 | A1 | 7/2009 | Lee | |
| 2009/0249700 | A1* | 10/2009 | Peterson | E04H 15/06 5/413 AM |
| 2011/0290843 | A1 | 12/2011 | Sagan | |
| 2012/0085804 | A1 | 4/2012 | Christy | |
| 2016/0213128 | A1* | 7/2016 | Maxfield | A45F 3/10 |
| 2016/0235186 | A1* | 8/2016 | Chueh | A45F 3/04 |
| 2017/0027806 | A1 | 2/2017 | Lin | |
| 2017/0238681 | A1* | 8/2017 | Bonnema | A45F 3/12 |
| 2019/0133304 | A1* | 5/2019 | Shir | A45F 3/12 |
| 2019/0191837 | A1* | 6/2019 | Richards | A45C 7/0063 |

* cited by examiner

BACKPACK WITH AIRFLOW SYSTEM

CROSS REFERENCE TO RELATED APPLICATIONS

The present application is a continuation of U.S. Non-Provisional application Ser. No. 16/719,752, entitled "BACKPACK WITH AIRFLOW SYSTEM", and filed on Dec. 18, 2019. U.S. Non-Provisional application Ser. No. 16/719,752 claims priority to U.S. Provisional Application No. 62/783,082, entitled "BACKPACK WITH AIRFLOW SYSTEM", and filed on Dec. 20, 2018. The entire contents of the above-listed applications are hereby incorporated by reference for all purposes.

FIELD

The present description relates generally to a backpack with an airflow system designed to generate airflow between a backpack and a user during backpack use.

BACKGROUND AND SUMMARY

Backpacks designed to carry equipment, supplies, etc., are used in a variety of activities such as work, school, and travel as well as sporting endeavors (e.g., hiking, cycling, skiing, skateboarding, running, and the like). A conventional backpack includes shoulder straps extending over a user's shoulders and a back panel in contact with the user's back. The contact area between the back panel and the user, as well as the limited breathability, traps heat generated by the user, resulting in perspiration that can saturate clothing and the back panel. The insulative properties of the backpack are particularly problematic when the backpack is used in strenuous activities (e.g., cycling, running, and the like). During these activities, users typically generate elevated levels of heat and sweat, leading to significant user discomfort. Consequently, customer satisfaction and product demand are correspondingly decreased.

Attempts have been made to incorporate raised polyfoam pads in backpacking style packs to alleviate pressure points and prevent padded sections from wrinkling or bunching up. However, the polyfoam pad layout does not promote active airflow between the pads during use, exacerbating the pack's thermal management issues. Specifically, the channels between the pads are not orientated and contoured to drive efficient airflow through the channels. For instance, the channels are shallow and do not promote cross-flow, hindering user cooling and sweat evaporation.

Other attempts have been made in previous backpack designs to increase back panel cooling by incorporating mesh into an outer layer of the back panel to increase airflow and promote sweat evaporation. However, the mesh may not generate levels of cooling and sweat evaporation desired for certain recreational activities such as cycling, running, skiing, etc., leading to backpack discomfort. Consequently, previous back panel designs have not achieved a desired level of airflow promoting convective and evaporative cooling of the user.

In one example, the issues described above may be at least partially addressed by a backpack comprising a storage compartment; and a back panel coupled to the storage compartment and having an airflow system including a plurality of preformed protrusions extending outward from a base of the back panel, the plurality of preformed protrusions arranged in columns parallel with a central axis of the back panel; and a plurality of air channels positioned between the plurality of preformed protrusions and configured to direct airflow along at least two directions through the back panel, wherein one air channel of the plurality of air channels is positioned in a central region of the back panel and extends down from a top of the back panel to at least halfway along a length of the back panel, parallel with the central axis.

In this way, the airflow system includes protrusions arranged in a manner that promotes airflow between a user's back and the back panel. Consequently, cooling of a user may be increased while also increasing the amount of sweat evaporating during activity when compared to previous back panel designs. Therefore, the comfort of the backpack is increased, thereby increasing customer satisfaction. In this example, each of the plurality of raised protrusions may include interior airflow passages extending through the protrusions. The airflow channels along within the protrusions allow the backpack to achieve additional cooling and sweat evaporation.

In another example, a backpack is provided with a back panel coupled to the storage compartment and including an airflow system with a raised outer section having a set of inner airflow channels offset from a set of outer airflow channels.

In yet another example, a backpack is provided with a back panel having an outer section including a plurality of columns of curved recesses and openings extending through the outer section. The curved recesses along with the openings allow for increased vertical and lateral airflow across a user's back to be generated when the pack is in use, when compared to previous back panels. This tuned airflow pattern results in increased cooling of the user as well as increased perspiration evaporation, thereby improving user comfort. In such an example, the back panel may further include a reinforcement section arranged in an interior position with regard the outer section. The reinforcement section may be constructed out of a denser foam than the outer section. In this way, the outer panel is designed with greater compliance to increase backpack comfort by reducing pressure points in the back panel while the reinforcement section provides a desired amount of structural integrity to the back panel.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-12 are shown approximately to scale. However, other relative dimensions may be used in other embodiments.

DETAILED DESCRIPTION

Figure 1:
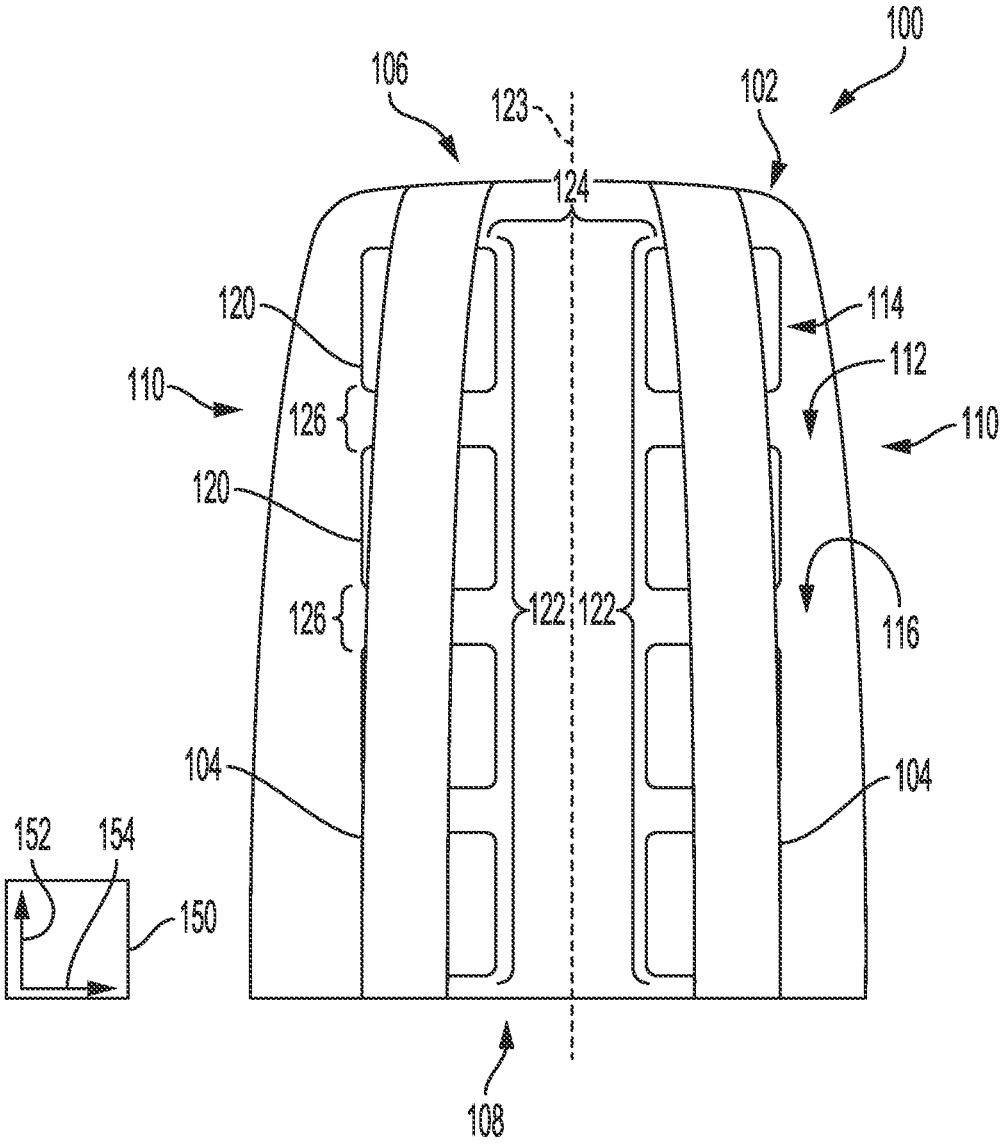
FIG. 1 shows an embodiment of a backpack with a back panel having an airflow system.

The following description relates to a backpack with a back panel having an airflow system allowing airflow through a back panel to increase during pack use, when compared to previous back panel designs. The airflow system includes raised protrusions extending from a base of the back panel and defining boundaries of vertical and lateral flow channels intersecting one another. The protrusions may be preformed of a rebounding material that compresses when pressure is applied and returns to an original shape when the pressure is removed. The intersecting vertical and lateral flow channels promote an active airflow pattern, including a centrally located vertical flow channel providing a main airflow path with intersecting air junctions, e.g., the lateral flow channels, branching from the main airflow path. The active airflow pattern produces more airflow across a wider range of the back panel to increase cooling and sweat evaporation. Furthermore, the airflow system creates a synergistic balance between airflow throughput and the back panel's supportive characteristics. This synergistic balance results in a backpack providing both desirable thermal and comfort characteristics, and increases the backpack's consumer appeal.

In one example, each of the plurality of protrusions may include interior airflow passages extending (e.g., laterally extending) through a body of the protrusion. In this way, the back panel may be cooled to an even greater extent during use of the backpack.

In another example, each of the plurality of protrusions may include a planar outer surface designed to contact a user's back. The planar surface may increase the backpack's comfort by reducing pressure points while directing airflow into channels between the protrusions, to further increase user cooling.

In another example, a first number of the protrusions may be trapezoidal in shape, while a second number of the protrusions may be triangular in shape, which may increase airflow into channels between the protrusions. In this way, the back panel may be cooled to a greater extent during use.

In another example, the back panel includes a column of curved protrusions. Continuing with this example, apices of each of the curved protrusion in the column are laterally offset from adjacent protrusions. In this way, the airflow pattern can be tuned to direct increased airflow down the user's back as well as across the back.

In another example, the airflow system in the back panel includes an outer section having a plurality of columns of curved recesses. In this example, the elevational variance in the back panel is formed by sections (e.g., planar sections) extending between the recesses. Each recess may have an opening directing air into flow channels interior to the back panel to promote active airflow through the back panel during pack use. Additionally, in such an example, the airflow system may include a mesh layer extending over at least a portion of the recesses. The mesh layer reduces backpack slippage without substantially affecting the cooling capabilities of the airflow system, thereby increasing the backpack's wearability. Further in one example, the back panel may include a reinforcement section positioned internal to the outer section. Additionally, the reinforcement section may be constructed out of a denser material than the outer section. In this way, the outer section is designed with increased compliance, allowing for a more comfortable fit for the user when compared to denser foam paneling. The reinforcement section and outer section may be profiled to drive internal airflow to further increase user cooling.

Figure 4:
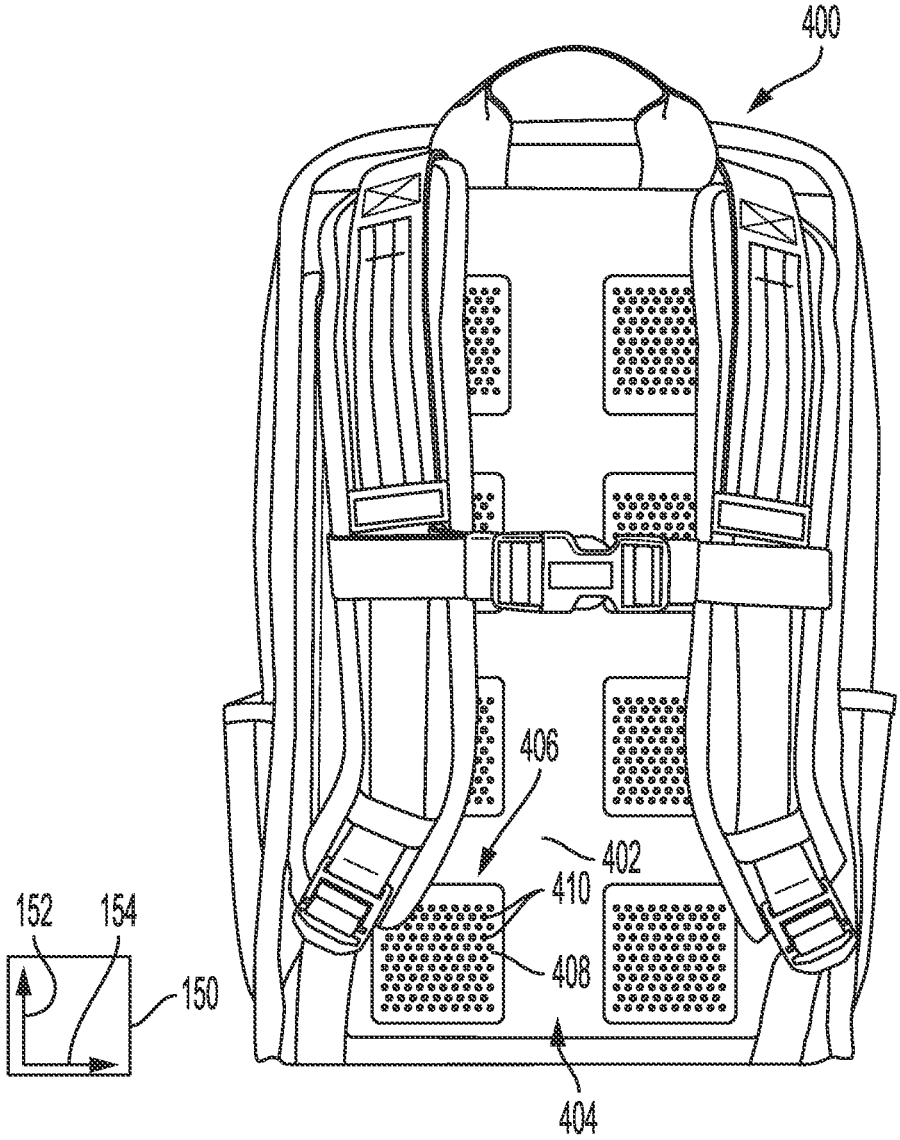
FIG. 4 shows a second embodiment of a backpack with a back panel having an airflow system.
Figure 5B:
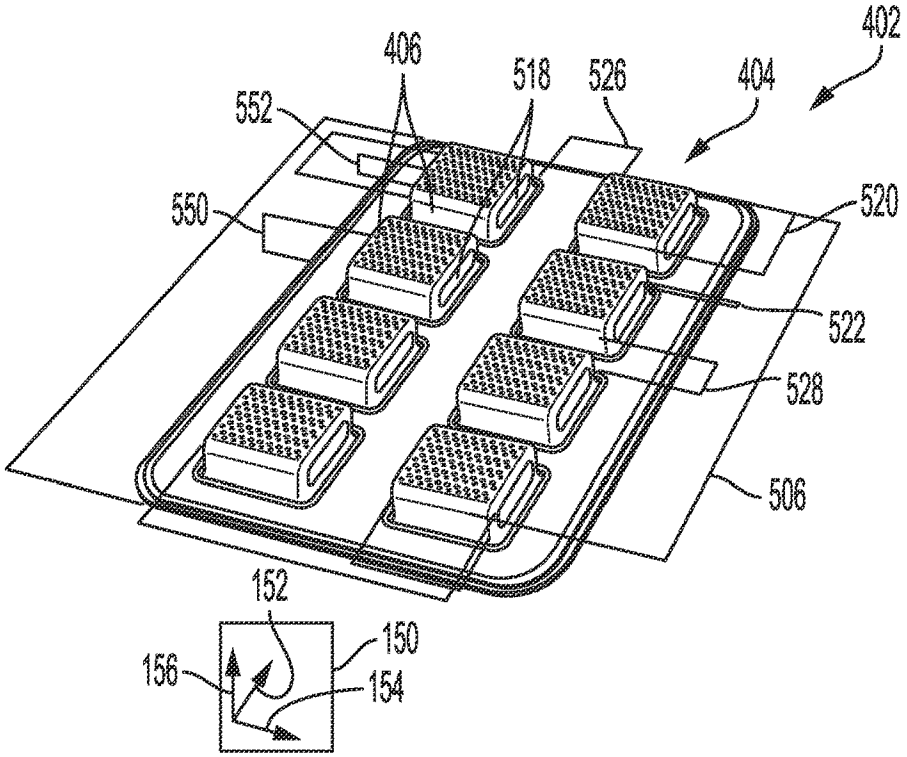
FIG. 5B shows a perspective view of the back panel with the airflow system, shown in FIG. 4.
Figure 6A:
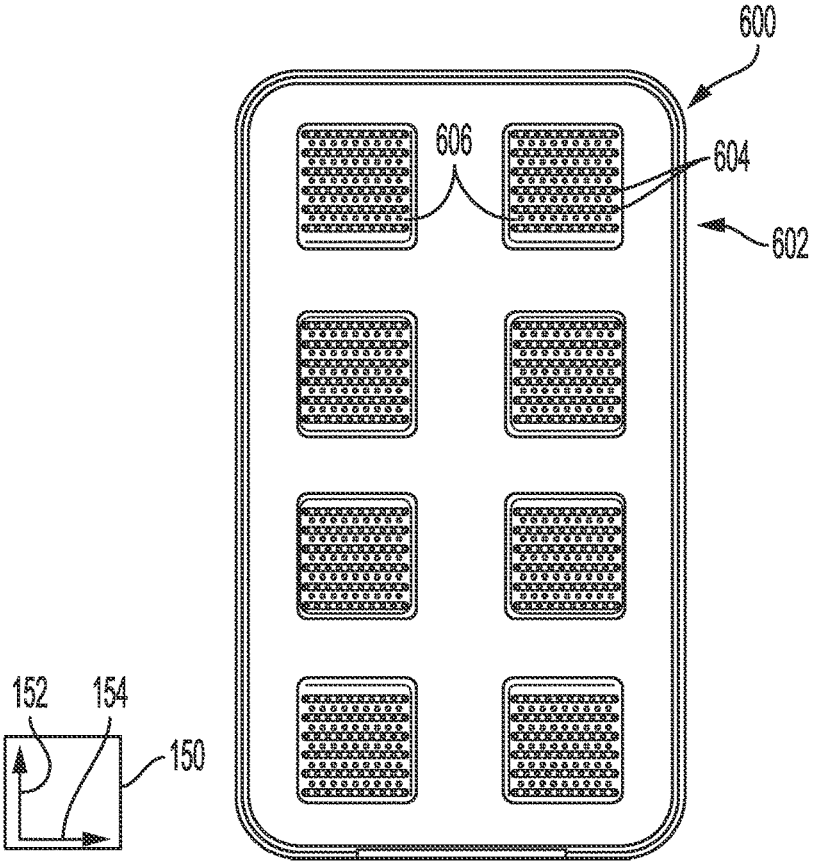
FIG. 6A shows another embodiment of a back panel with an airflow system.
Figure 6B:
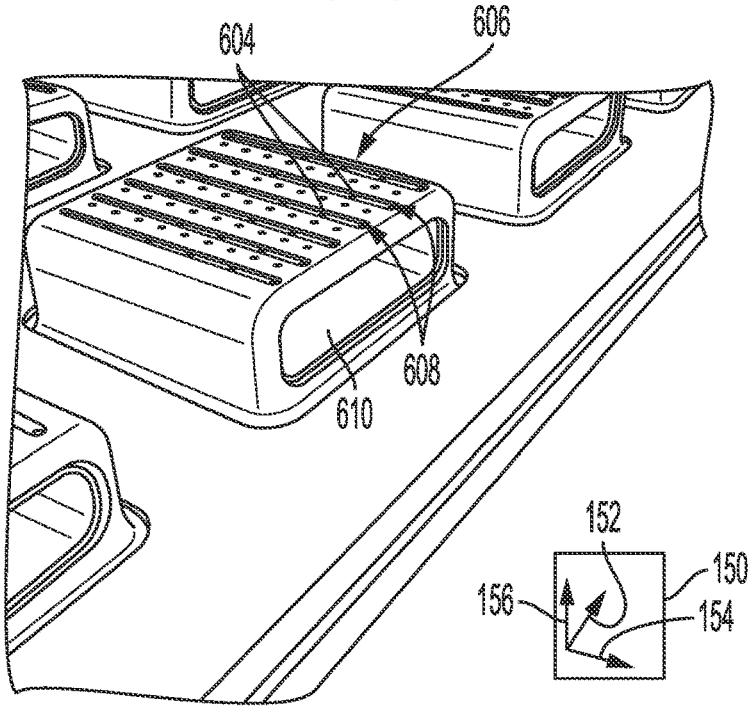
FIG. 6B shows an expanded view of a portion of the back panel, shown in FIG. 6A.
Figure 7:
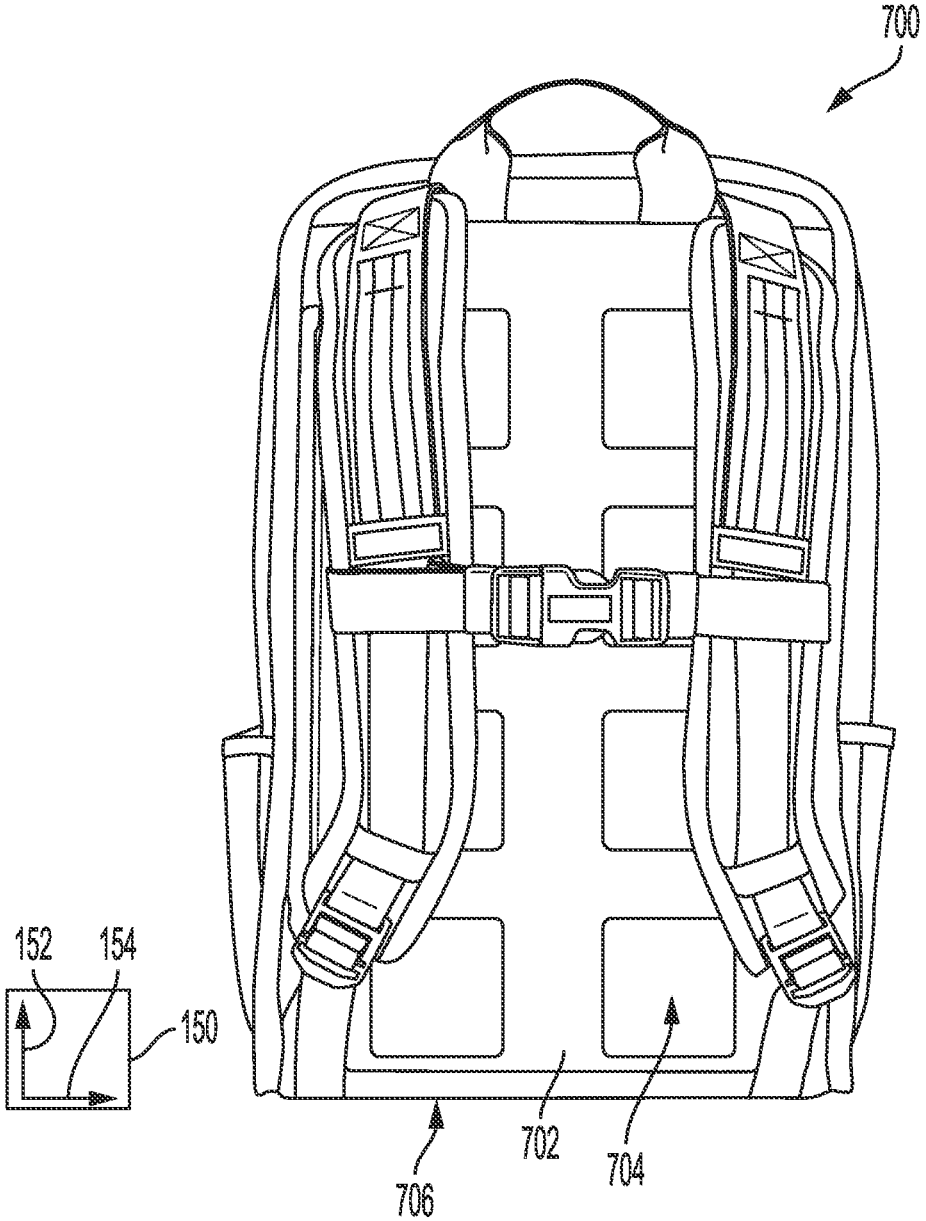
FIG. 7 shows a third embodiment of a backpack with a back panel having an airflow system.
Figure 11A:
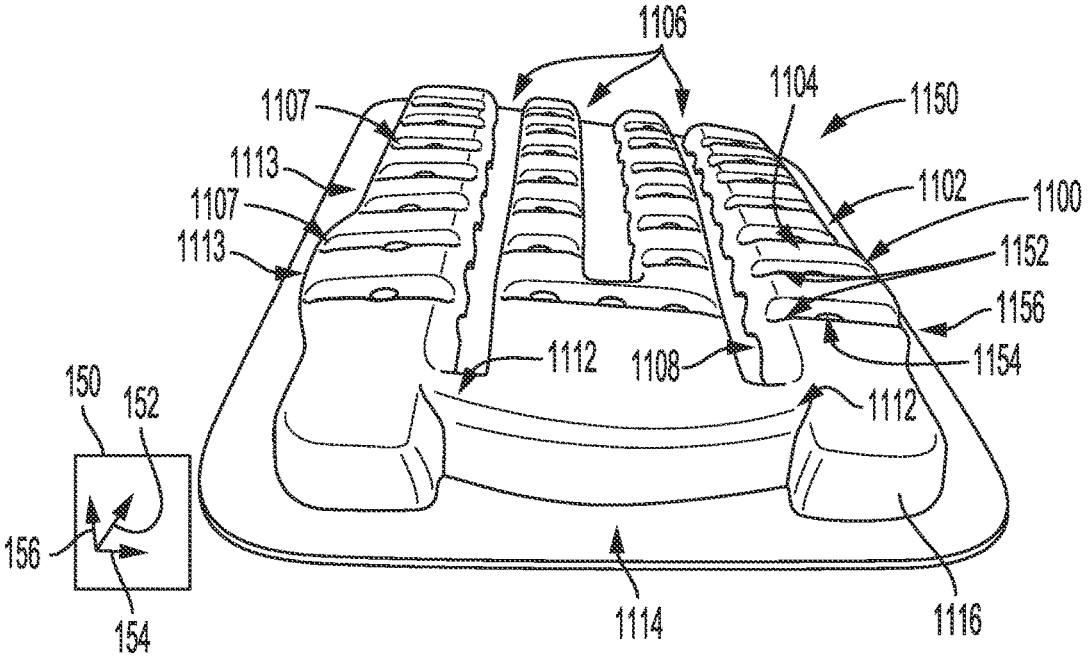
FIGS. 11A-11B show another embodiment of a back panel with an airflow system.
Figure 11B:
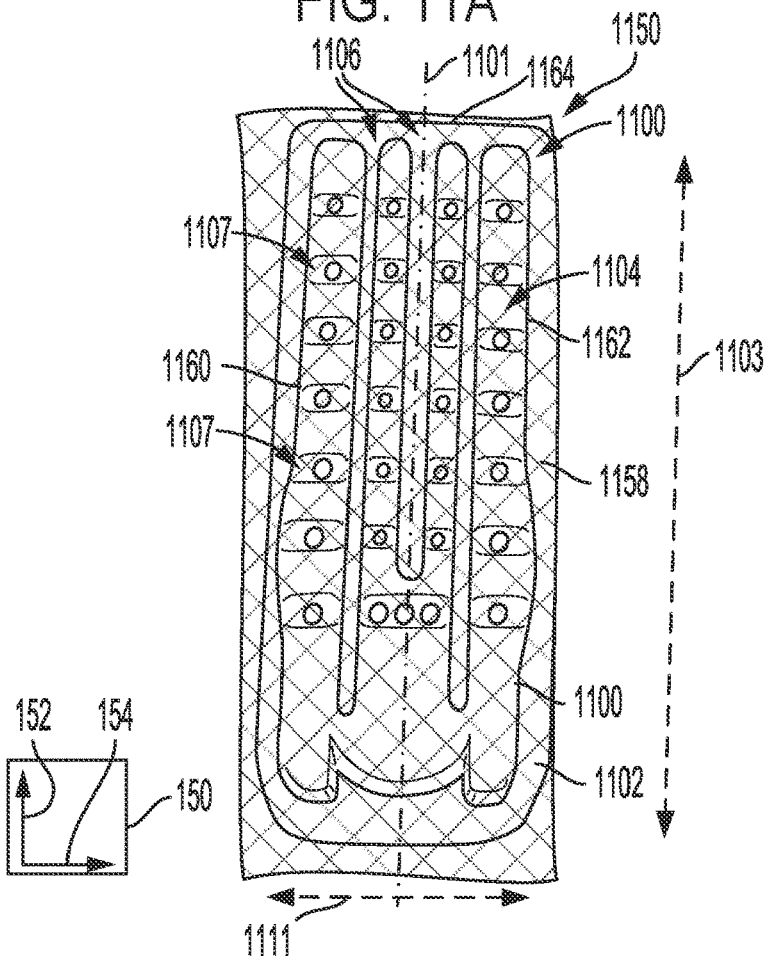
Figure 12:
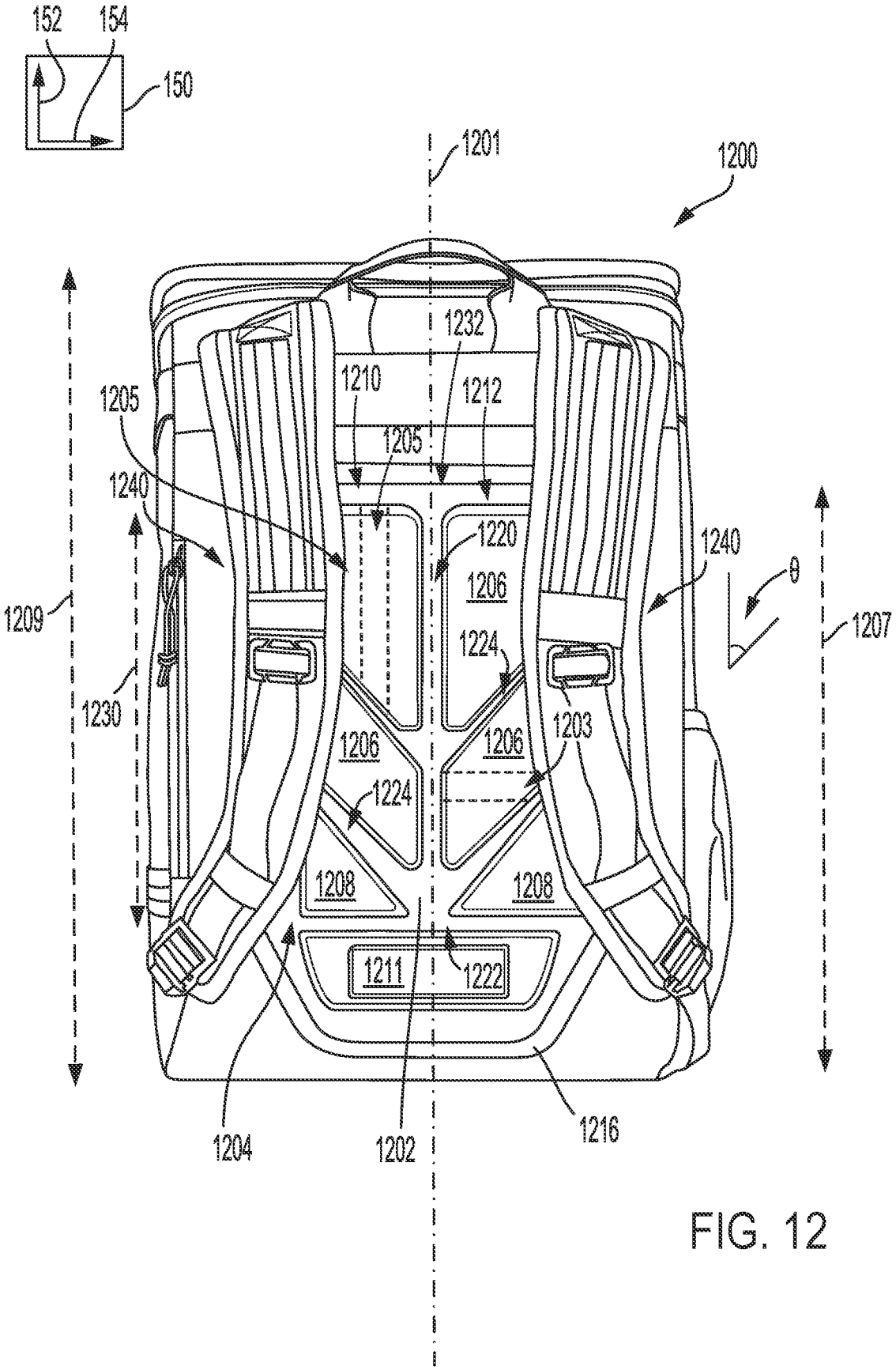
FIG. 12 shows another embodiment of a back panel with an airflow system.

FIGS. 1-3C show a first embodiment of a backpack with an airflow system including protrusions promoting vertical and lateral airflow through a back panel. FIGS. 4-5C show a second embodiment of the backpack with an airflow system having perforated protrusions further increasing airflow through the back panel. FIGS. 6A-6B show a back panel with protrusions have a different perforation layout. FIGS. 7-8B show a third embodiment of the backpack with an airflow system having an external material covering a portion of the protrusions. FIGS. 9A-9C show another example of an airflow system in a back panel having louvers promoting increased airflow through the back panel while providing a comfortable fit to a user. FIGS. 10A-10D show a fourth embodiment of a backpack with an airflow system having a plurality of curved recesses in an outer section and a reinforcement section providing structural pack support while driving active airflow during use of the pack. FIGS. 11A-11B and FIG. 12 show additional embodiments of a back panel with an airflow system.

Turning now to FIG. 1, a backpack 100 is shown. The backpack 100 includes a front section 102 with one or more interior compartment(s) allowing equipment, supplies, small articles, etc., to be carried in the backpack. The interior compartment may closable via one or more zippers, buttons, clasps, buckles, combinations thereof, etc.

The backpack 100 further includes shoulder straps 104 allowing a user to carry the backpack on their shoulders. The shoulder straps 104 are identical to one another, in the illustrated embodiment. However, in other embodiments, the straps may have different sizes, profiles, and material constructions, or the backpack may include one strap. The shoulder straps 104 extend vertically down the backpack 100 from a top side 106 to a bottom side 108 of the backpack 100, in the illustrated example. Additionally or alternatively, the shoulder straps 104 may be attached to lateral sides 110 of the backpack 100.

The backpack 100 further includes a back panel 112 with an airflow system 114 positioned on a backside 116 of the backpack. The airflow system 114 allows vertical and lateral airflow to be actively generated during use of the backpack. Consequently, increased cooling and perspiration evaporation can be achieved during use of the pack to improve user comfort and the pack's consumer appeal. The active airflow features may be particularly useful in backpacks designed for outdoor activities such as cycling, running, skiing, snowboarding, hiking, etc. However, the backpacks described herein may be used in other realms such as work, travel, day-to-day activities, etc.

The airflow system 114 includes a plurality of protrusions 120. The protrusions 120 are arranged in columns 122. Specifically, in the illustrated example, the columns are aligned along a vertical axis 123 of the back panel 112. However, other column arrangements have been envisioned.

A vertical airflow channel 124 and lateral airflow channels 126 are formed between the protrusions 120, in the illustrated embodiment. The airflow channels guide air in a desired pattern during use of the pack to increase user cooling and sweat evaporation. The specifics of the airflow channel layout and corresponding flow dynamics are discussed in greater detail herein with regard to FIG. 2.

An axis system 150 is depicted in FIG. 1 as well as FIGS. 2-11B to establish a common frame of reference. The axis system 150 includes axes 152, 154, and 156, perpendicular to one another. The axis 152 may be a vertical axis, in one example, parallel to a gravitational axis. The axis 154 may also be a lateral axis and/or the axis 156 may be a longitudinal axis, in one example. However, the axes may have other orientations, in other examples. Furthermore, it will be appreciated that when in use, the backpack may be orientated in a variety of positions with regard to a gravitational axis.

Figure 2:
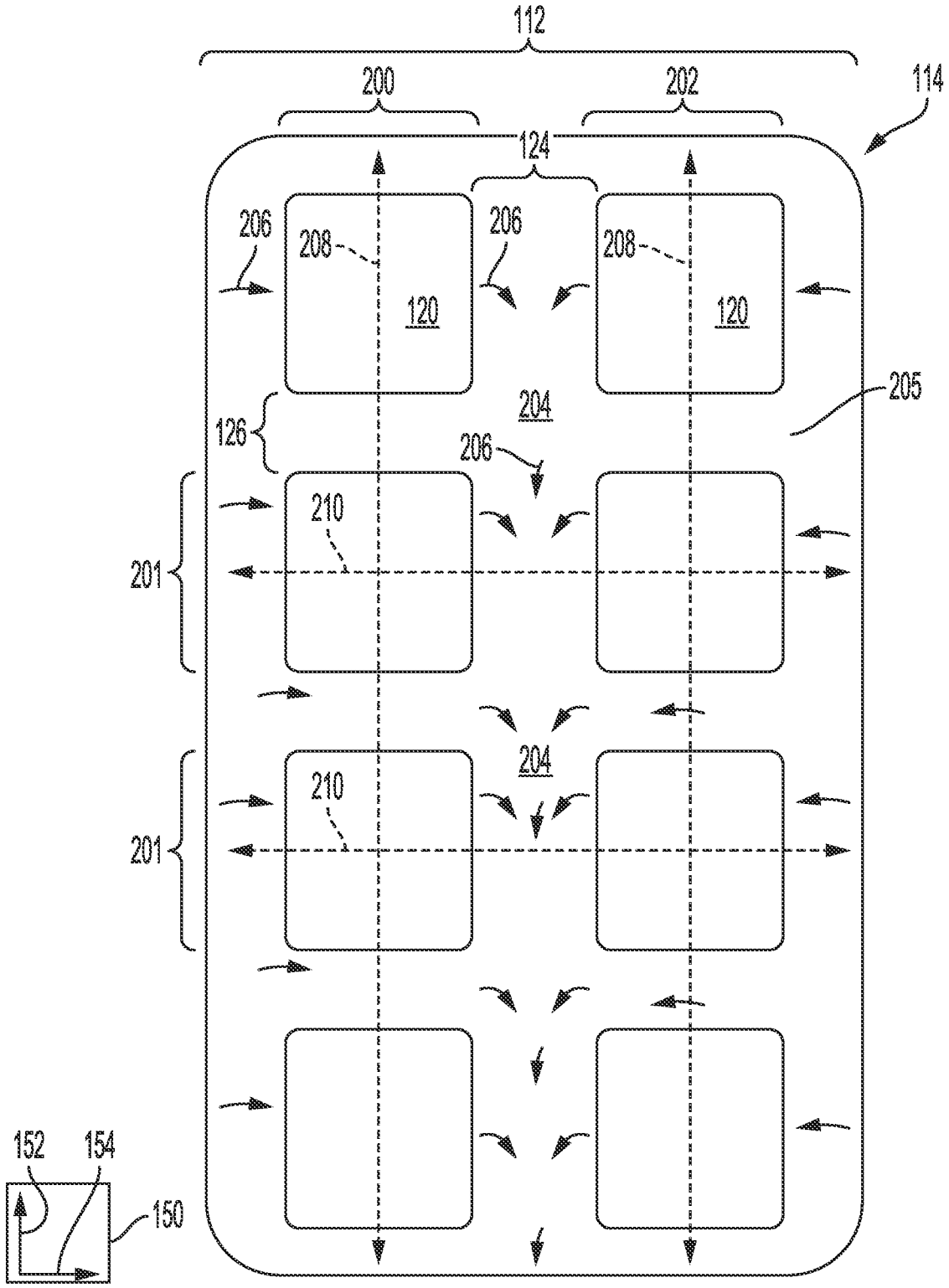
FIG. 2 shows a detailed view of the back panel with the airflow system, shown in FIG. 1.

FIG. 2 shows a detailed view of the back panel 112 and airflow system 114. The plurality of protrusions 120 are again shown extending from a base 205 of the back panel 112. The base 205 has a planar outer surface, in the depicted embodiment. However, other base profiles such as textured profiles, profiles with concave curvatures in one or more of the airflow channels, etc., may be used in other embodiments. The airflow system 114, in the illustrated example, includes four rows 201 of protrusions. However, other designs may include fewer or more than four rows. A first column 200 and a second column 202 of the protrusions 120 are also delineated in FIG. 2. The first column 200 is laterally spaced apart from the second column 202. Additionally, the first column 200 and the second column 202 are aligned along axes 208, parallel to the vertical axis 152. The rows 201 are also aligned along axes 210. In other words, the protrusions 120 are evenly spaced along the lateral and vertical axes, 154 and 152, respectively. Sequential protrusions in the first column 200 are therefore laterally aligned with a corresponding protrusion in the second column 202. In this way, cross flow in the back panel 112 may be promoted during use of the pack. In other examples, however, the spacing between the protrusions in either the vertical or the lateral direction may be varied and/or the protrusion may be arranged in a single column or more than two columns. Furthermore, each of the protrusions 120 have a similar size and profile, in the illustrated example. However, in other examples, there may be a variance in size and/or profile of the protrusions 120.

The airflow system 114 includes the vertical airflow channel 124 and lateral airflow channels 126, as previously mentioned. It will be appreciated that in other examples, the airflow system 114 may include multiple vertical airflow channels. The vertical airflow channel 124 and the lateral airflow channels 126 meet at intersections 204. Arranging the airflow channels in this configuration allows an airflow pattern to be generated with both vertical and lateral components to increase cooling of the user during use of the backpack when compared to previous backpack designs. Specifically, air may be directed into the channels from both the lateral and top sides of the back panel to increase airflow throughput. It has been found through extensive testing of the airflow system 114 that the design depicted in FIG. 2 has the ability to capture up to 41% of the wind speed traveling around the side and back of a user wearing the pack, in certain scenarios. Arrows 206 indicate the general direction of airflow through the back panel 112, highlighting the improved airflow pattern. However, it will be appreciated that, in practice, the airflow pattern has greater complexity than is illustrated. The flow arrows 206, also show air traveling through internal airflow passages. The internal passages are discussed in greater detail herein with regard to FIGS. 3A-3B.

Figure 3A:
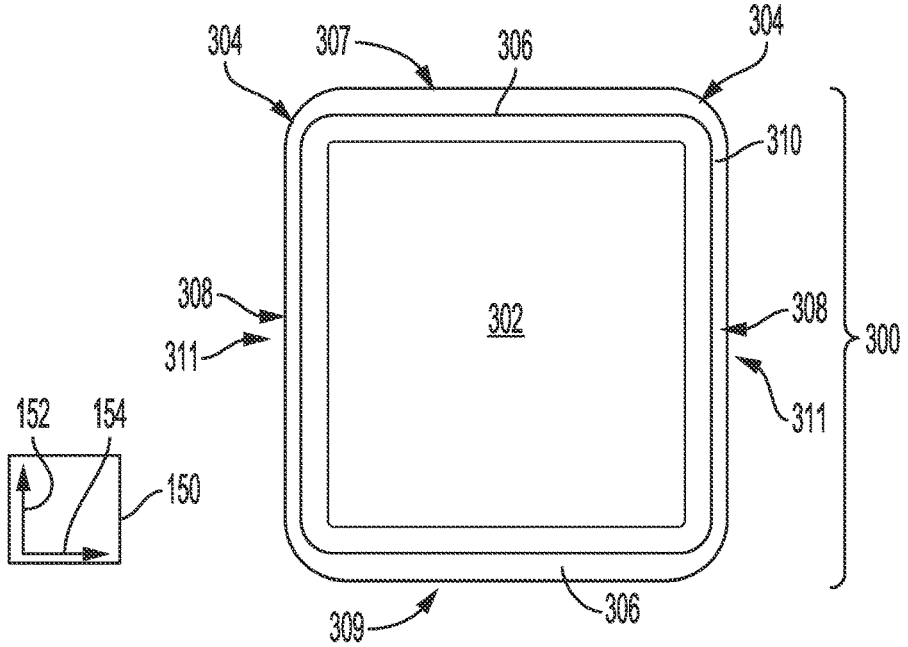
FIGS. 3A, 3B, and 3C show detailed views of one of the protrusions included in the airflow system, depicted in FIG. 2.

FIG. 3A shows a detailed view of one protrusion 300 in the plurality of protrusions 120, depicted in FIGS. 1 and 2. It will be appreciated that the plurality of protrusions 120, shown in FIGS. 1 and 2 may have substantially identical profiles and sizes. Specifically, the height, as defined along the axis 156, of the protrusions may be substantially identical to allow for desired airflow dynamics in the flow channels to be achieved. As such, the protrusion 300, shown in FIG. 3A exemplifies features of the plurality of protrusions 120, shown in FIG. 2. However, in other examples, the sizes and/or profiles of the protrusions may vary. For instance, the size of the protrusions may sequentially increase or decrease in size with regard to a vertical direction. In another example, the protrusions may include multiple sizes (e.g., a larger size and a smaller size). In such an example, the sizes may sequence from the larger size to the smaller size, and so on, in the column. The size of the protrusions 120, shown in FIGS. 1 and 2, may be selected based on a targeted amount of structural support provided by the protrusions as well as airflow channel throughput targets. As such, a balance may be struck between air throughput and structural support in the back panel.

The protrusion 300, shown in FIG. 3A, includes an outer surface 302. The outer surface 302 is planar, in the depicted example. The planar profile of the outer surface 302 allows a greater surface area of the back panel to contact a user's back during use. Consequently, back panel slippage with regard to the user's back may be decreased. Additionally, planar top surfaces of the protrusions also allow loads to be more widely dispersed across the user's back to decrease back panel pressure points. As a result, the comfort of the backpack is increased while also reducing the likelihood of unwanted pack movement during usage. However, outer surfaces with alternate profiles (e.g., convex, concave, textured, etc.,) have been envisioned. Specifically, in one example, the outer surface may have a convex curvature which may include an apex at the center of the protrusion. In other examples, some of the protrusions may include planar outer surfaces and some may include curved outer surfaces.

By implementing curved protrusions extending outward from the back panel, e.g., protrusions with curved surfaces along which air flows, air flow across the curved surface may faster than, for example, if the protrusion had perpendicular corners. As such, embodiments of the back panel described herein all have curved surfaces to promote rapid air flow. The curvature of the surfaces further directs air into the channels formed between the protrusions, thereby enhancing cooling air flow between a user's back and the backpack.

The outer surface 302 also forms a substantially square shape, in the illustrated example. Other shapes have also been contemplated such as rectangular shapes, triangular shapes, circular shapes, oval shapes, etc. Additionally, the corners 304 of the protrusion 300 are curved to increase comfort of the back panel by removing sharp corners from the back panel. However, in other examples, the corners may be less rounded.

Figure 3B:
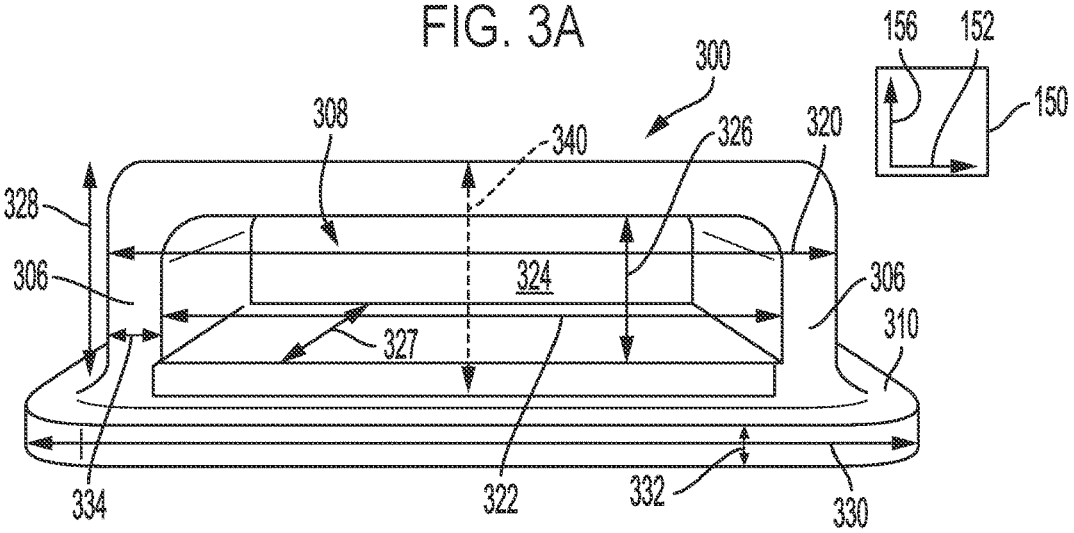

The protrusion 300 also includes sidewalls 306 on a top side 307 and a bottom side 309 of the protrusion. Openings 308 to an interior flow passage 324, shown in FIG. 3B, are also shown in FIG. 3A. The openings 308 are positioned in lateral sides 311 of the protrusion, in the depicted example. In this way, air is laterally guided through the protrusions, allowing for further gains in cooling of the user during backpack use to be achieved. The lateral flow channels may be particularly useful when the backpack is utilized in sports such as cycling where the position of the user's head and shoulders block a portion of the airflow traveling into the vertical channel at a top of the back panel. However, the openings 308 may be positioned in the top and/or bottom side of the protrusion, in other examples. Thus, in these examples, air may be guided vertically through at least some of the protrusions. Further in some examples, the openings to the interior flow passage 324 may be positioned on a vertical side and a horizontal side of the protrusion.

The interior airflow passage 324 is shown arranged symmetrically with regard to a central axis 340 of the protrusion 300. However, in other examples, the airflow channel may be offset with regard to the central axis 340. Moreover, the sizes of the interior airflow passages in the back panel may be varied with regard to sequential protrusions in the columns. For instance, the sizes of the airflow passages may increase or decrease in size with regard to a vertical direction. In such an example, corresponding interior airflow passages in the rows of the protrusion may have a similar, size, vertical position, and/or profile. In this way, lateral flow alignment through the interior passages may be achieved. However, in other examples, the interior airflow channels in the rows may be offset with regard to a lateral axis.

The protrusion 300 is also shown including a base 310 from which the sidewalls 306 extend. The base 310 is shaped with a flange facilitating efficient attachment to other sections of the back panel. However, in other examples, the flange may not be included in the protrusion.

FIG. 3B shows a side view of the protrusion 300. Specifically, the openings 308, interior flow passage 324, and sidewalls 306, are illustrated. A vertical width 320 of the protrusion 300, a vertical width 322 of the interior flow passage 324, a longitudinal height 326 of the interior flow passage, a lateral length 327 of the interior flow passage, a longitudinal height 328 of the protrusion, a vertical width 330 of the base 310, and a longitudinal height 332 of the base, are shown in FIG. 3B. In the illustrated embodiment, the width 320 of the protrusion 300 is greater than the height 328 of the protrusion. In one example, the height 328 may be between 10-60 mm, 10-30 mm, 15-20 mm, 25-30 mm, or 27-28 mm, or any quantity between 10-60 mm. It has been found through airflow testing that providing a protrusion with a longitudinal height between 15-20 mm may provide a substantial increase in airflow over other designs. However, other height ranges of the protrusions also may provide improved airflow. The vertical width 320 of the protrusion 300 may be between 40-80 mm, in one example. However, other protrusion widths have been contemplated. The vertical width 330 of the base 310 is greater than the vertical width 320 of the protrusion 300 in the depicted embodiment. In this way, an attachment surface may be formed on a lower portion of the protrusion. Additionally, the longitudinal height 332 of the base 310 may be equal to or less than the thickness 334 of the sidewalls 306 of the protrusion 300, in one example. It will be appreciated, however, that different relative dimensions of the protrusion may be used in other instances with regard to the above-mentioned heights, widths, lengths, etc., of the protrusion and its corresponding features.

In one example, the protrusion 300 may be constructed out of a polymeric material such as closed and/or open cell foams (e.g., ethylene-vinyl acetate (EVA) foams, poly ethylene-vinyl acetate (PEVA) foams, polyurethane (PU) foams, microcellular foams, rigid foams, syntactic foams, polyethylene (PE) foams, etc.,), other polymeric materials such as PE (e.g., HDPE), fabrics (e.g., natural or synthetic), metal, combinations thereof, etc. In some examples, the foam used to construct the protrusion may have a specific gravity of between 35 to 50 degrees. It will be appreciated that providing a foam having a specific gravity in this range may strike a desired balance between protrusion support and protrusion compliance. However, foams with other specific gravities have been contemplated. It will be appreciated that in some examples, the back panel 112, shown in FIGS. 1-2, may also be constructed out of one or more of the above-mentioned materials. In such an example, the base and the protrusions of the back panel may be constructed out of a similar material or a combination of materials. However, in other examples, the base and the protrusions may be constructed out of different materials or combinations of materials. The material(s) used to construct the protrusion may be selected based on certain tradeoffs. To elaborate, by reducing compliance of the material used to construct the protrusion 300 the amount of cooling provided the airflow system might be increased at the expense of comfort. Consequently, the compliance of the material used to construct the protrusion may be selected with this tradeoff in mind. In some examples, multiple type of foam and/or other materials may be used to construct the protrusion 300 to avoid or diminish said tradeoff.

In some examples, the interior airflow passage 324 may be designed with a Venturi constriction to allow for additional airflow tuning. Therefore, in such an example, the passage may include a restriction. Continuing with such an example, an inlet may be included at the restriction. When the channels include a Venturi type restriction a desired airflow pattern increasing throughput of air in the back panel during use of the backpack may be achieved.

Figure 3C:
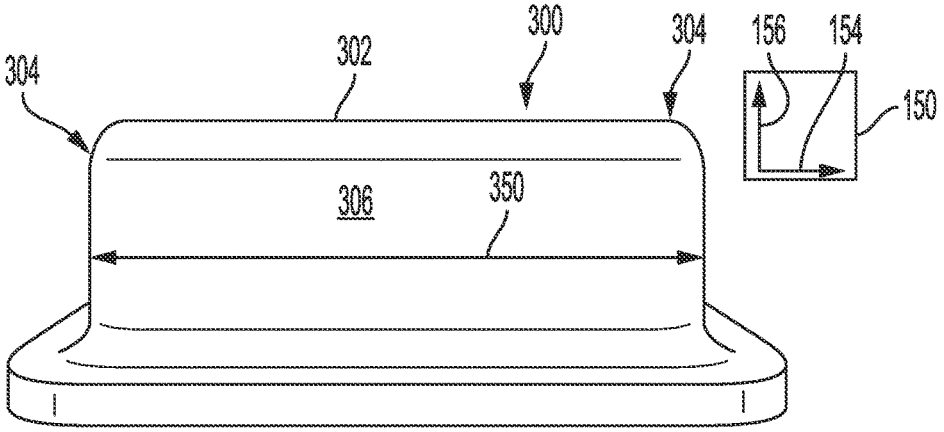

FIG. 3C shows another side view of the protrusion 300 where the sidewalls 306 are depicted. A lateral length 350 of the protrusion 300 is depicted. The lateral length 350 may be between 40-80 mm, in one example. The curved corners 304 and outer surface 302 of the protrusion are again illustrated. It will be understood that at least a portion of the outer surface 302 may be in contact with a user's torso during use of the backpack. Thus, the outer surfaces come into contact with the user and therefore support the weight of the pack. The amount of surface area contacting the user may be selected to achieve structural support goals while allowing for enough back panel air throughput to provide a desired level of cooling to the user.

FIG. 4 shows another embodiment of a backpack 400. The backpack 400 includes a back panel 402 with an airflow system 404 having some features similar to the backpack 100, shown in FIG. 1. Therefore, redundant description of these features is omitted. Furthermore, it will be appreciated that backpacks have been envisioned which combine different features from the different backpack embodiments described herein. As such, backpacks combining selected features from the variety of designs described herein have been contemplated.

The airflow system 404 again includes a plurality of protrusions 406. However, in the example shown in FIG. 4, outer surfaces 408 of the protrusions 406 includes perforations 410. The perforations 410 may extend through the protrusions into interior airflow passages, thereby fluidically coupling air external to the protrusions 406 to air inside the interior airflow passages. The perforations 410 serve to provide additional cooling of a user's torso and specifically the area of the torso in direct contact or in general proximity to the outer surface of the protrusions 406. As a result, the thermal loading of protrusions may be efficiently dissipated to provide more cooling to the user.

Figure 5A:
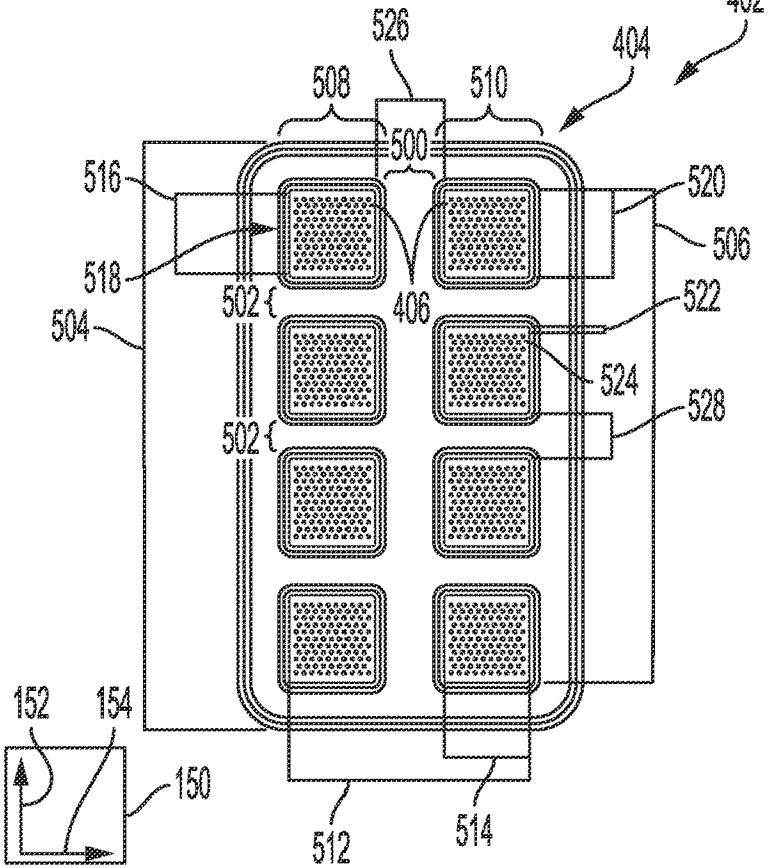
FIG. 5A shows a detailed view of the back panel with the airflow system, shown in FIG. 4.
Figure 5C:
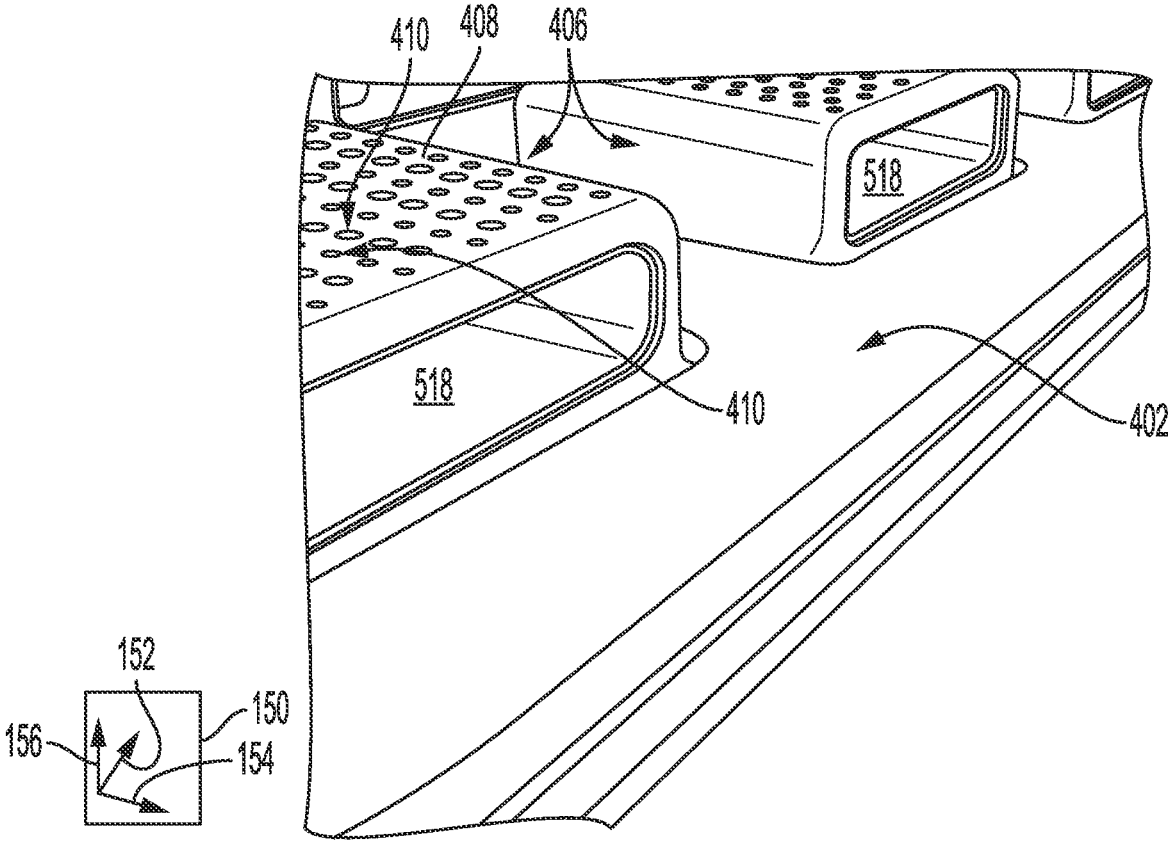
FIG. 5C shows a detailed view of the back panel with the airflow system, shown in FIG. 4.

FIG. 5A shows a detailed view of the back panel 402 and airflow system 404 in the backpack 400, shown in FIG. 4. It will be appreciated that the dimensions (e.g., relative dimensions) of the protrusions 406, a vertical airflow channel 500, and lateral airflow channels 502 may be selected to achieve targeted structural support and thermal management characteristics to increase user cooling and wearabililty during use. As previously mentioned, the protrusions 406 have substantially identical sizes and profiles, in the illustrated example. However, in other examples the protrusions 406 may vary in size and/or profile.

In one example, the vertical height 504 of the back panel 402 may be between 420-446 mm and specifically in one instance may be between 430-440 mm. The vertical length 506 of the first and second columns 508 and 510 may be between 340-380 mm or between 360-370 mm, in one specific example. The lateral width 512 of both columns, 508 and 510, and therefore the rows of the protrusions 406 may be between 170-190 mm. The lateral widths 514 of the protrusions 406 may be between 60-70 mm, in one example, and the widths 516 of the interior airflow passages 518 may be between 50-60 mm, in such an example. The vertical widths 520 of the protrusions 406 may also be between 60-70 mm, in one example. The thicknesses 522 of the walls 524 of the protrusions 406 may be between 3-8 mm, in one example. Additionally, the lateral widths 526 of the vertical airflow channel 500 may be between 40-60 mm, in one example. Furthermore, the vertical widths 528 of the lateral airflow channels 502 may be between 25-45 mm, in one example. The abovementioned dimensional ranges of the back panel are exemplary in nature and other dimensional ranges of the protrusion may be used, in other examples.

FIG. 5B shows a perspective view of the back panel 402 and the airflow system 404. The longitudinal heights 550 of the protrusions 406 may be between 20-40 mm, in one example. Additionally, the longitudinal heights 552 of the interior airflow passages 518 may be between 10-20 mm.

It will be appreciated that when the dimensions of the airflow channels and the protrusions have the abovementioned ranges, vertical and lateral airflow increases are achieved during pack use when compared to previous passive back panels. However, dimensions of the airflow channels, protrusions, etc., differing from the aforementioned ranges, values, etc., have been contemplated.

FIG. 5C shows a detailed view of a section of the back panel 402 including the protrusions 406, depicted in FIGS. 5A and 5B. The interior airflow passages 518 of the protrusions 406 are illustrated along with perforations 410 in the outer surfaces 408 of the protrusions 406. As previously discussed, the perforations 410 may extend through the protrusions into the interior airflow passages 518. As shown, the perforations 410 vary in size. Specifically, the perforations 410 include smaller size perforations and larger size perforations arranged in rows along the outer surface 408 of each protrusion. However, in other examples, the perforations 410 may have an equivalent size, the shape of the perforations may vary, the spacing between the perforations may vary, etc. The size, profile, and layout of the perforations may be selected based on end use airflow and user comfort design goals. Furthermore, the perforations in the different protrusions may vary in size and/or shape.

FIG. 6A shows another embodiment of a back panel 600 with an airflow system 602. The back panel 600 has similar features to the back panels shown in FIGS. 5A and 5B. However, in the back panel 600 shown in FIG. 6A the perforations 604 in the protrusions 606 have a different layout than the perforations 410 in FIGS. 5A and 5B.

Specifically, as shown in FIG. 6B, a portion of the perforations 604 in the protrusions 606 are positioned in grooves 608 extending across (e.g., laterally across along the axis 154) the protrusions 606. Positioning some of the perforations 604 in the grooves 608 may increase airflow through the perforations 604, resulting in even greater cooling and sweat evaporation. The grooves 608 may also provide a textured surface contacting the user's torso to reduce pack slippage during use. The perforations 604 again may extend through the protrusion 606 into an interior airflow passage 610. However, in another example, at least a portion of the perforations may not extend through the protrusion.

FIG. 7 shows another embodiment of a backpack 700. Again, the backpack 700 includes similar features to the backpack 400 shown in FIG. 4. However, the backpack 700 shown in FIG. 7 does not include perforations in the protrusions but rather a textured outer layer 702 at least partially covering the protrusions 704 and other sections of the back panel 706. The textured outer layer 702 may be a fabric constructed out of synthetic fiber and/or natural fibers such as nylon, spandex, fleece, cotton, wool, combinations thereof, etc. The outer layer 702 reduces slippage between the back panel 706 and the wearer's torso. This characteristic may be particularly beneficial when the backpack is used in vigorous activities such as cycling (e.g., road biking, mountain biking, etc.,), running, skiing, etc. The textured outer layer 702 may also be designed to wick away moisture during backpack use, in some embodiments.

Figure 8A:
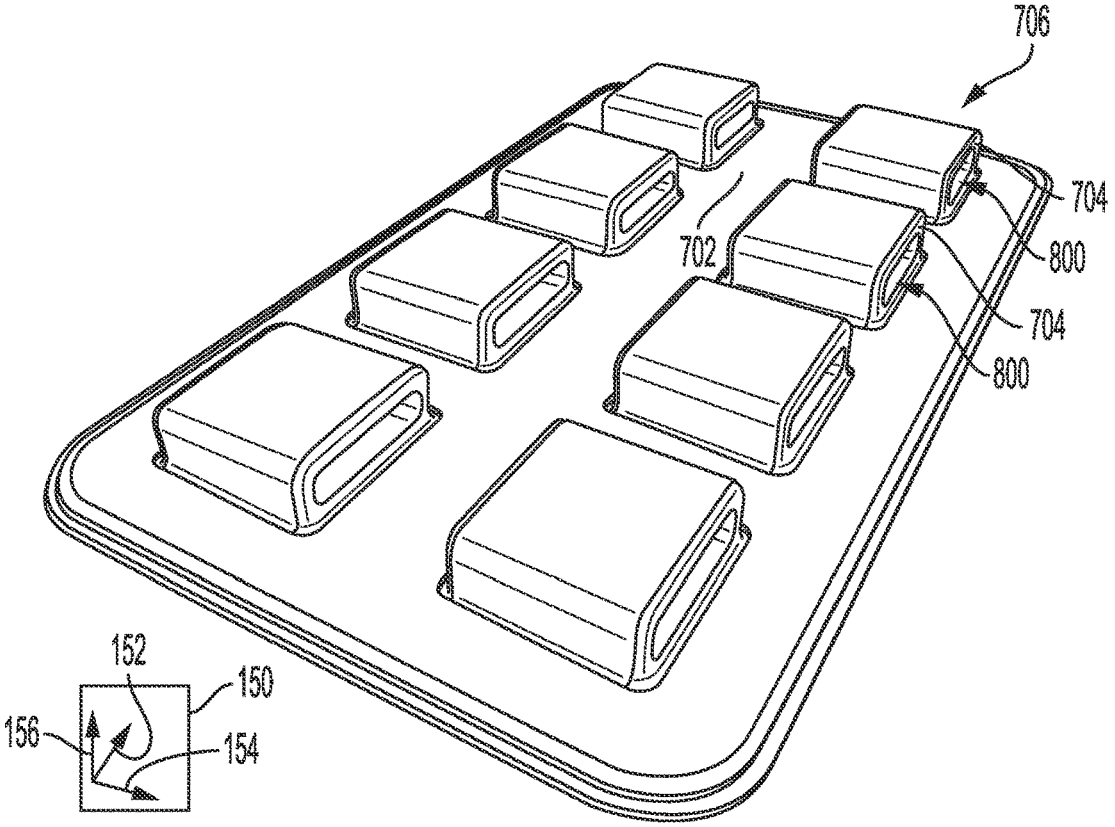
FIG. 8A shows a detailed view of the back panel in the backpack, shown in FIG. 7.
Figure 8B:
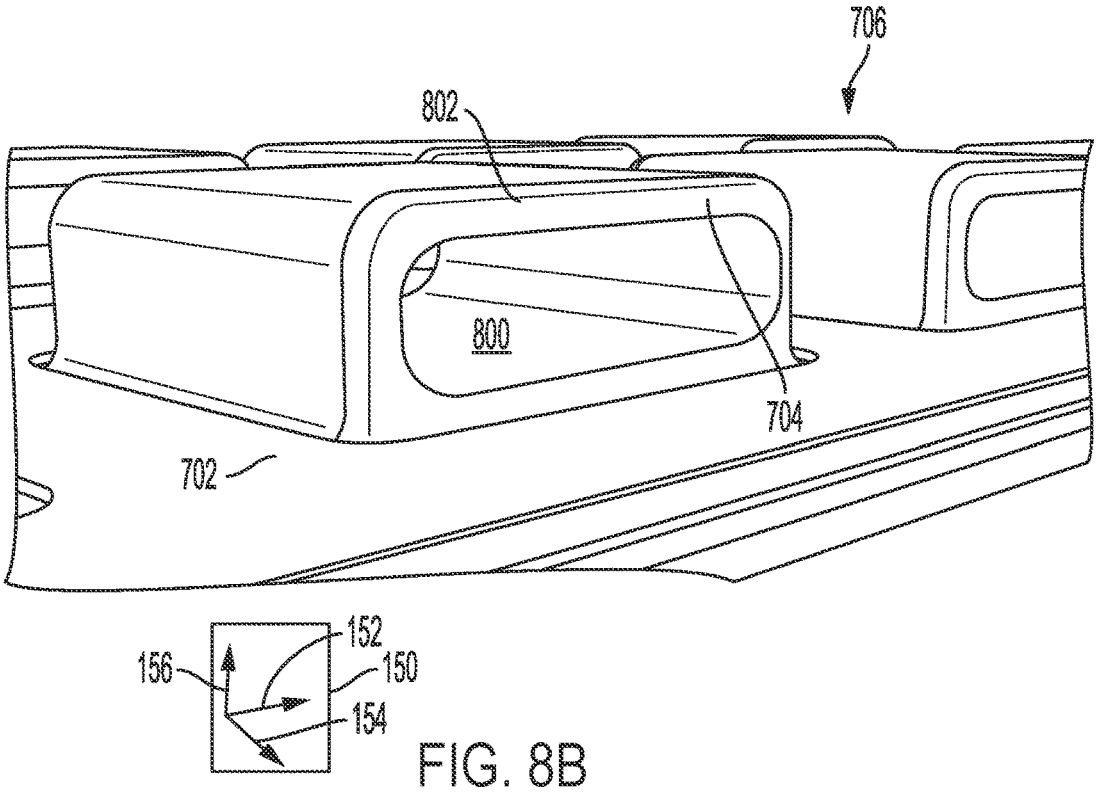
FIG. 8B shows an expanded view of a portion of the back panel, shown in FIG. 8A.
Figure 9A:
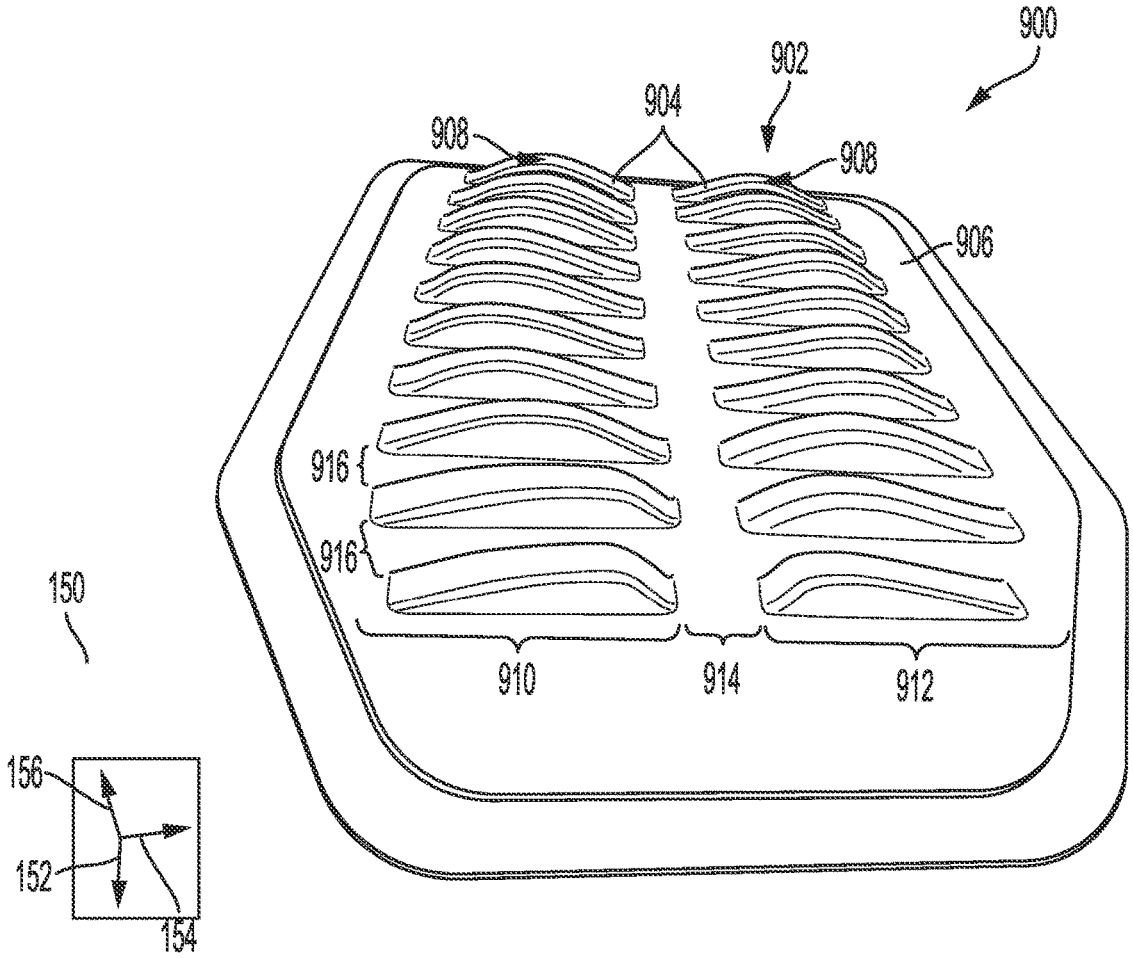
FIGS. 9A-9C show different views of another embodiment of a back panel including an airflow system.
Figure 9B:
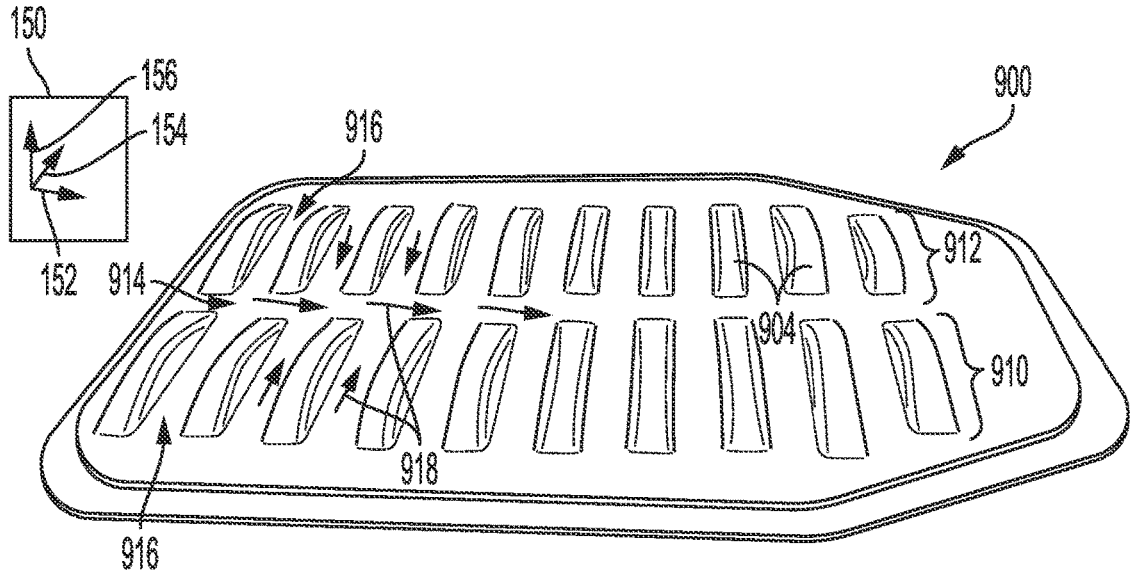
Figure 9C:
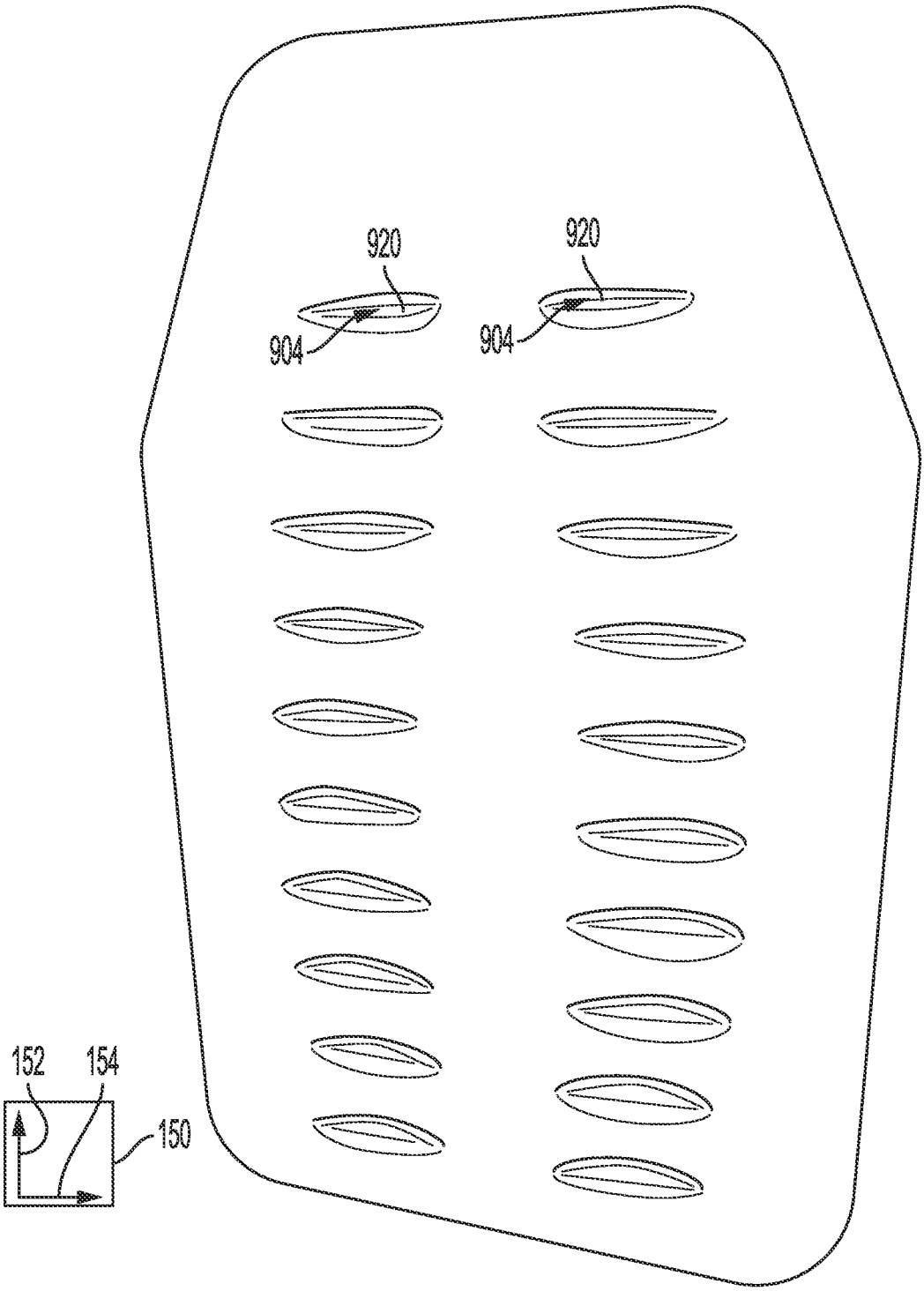

FIG. 8A shows a perspective view of a section of the back panel 706. Interior airflow passages 800 extending through the protrusions 704 are again shown, along with the outer layer 702. As illustrated, the textured outer layer 702 does not block the openings to the interior airflow passages 800. However, other outer layer profiles may be used in other examples.

FIG. 8B shows a detailed view of a portion of the back panel 706, shown in FIG. 8A. The interior airflow passages 800 in the protrusions 704 along with the textured outer layer 702 are again depicted. As described above, in some examples, the textured outer layer 702 may cover an outer surface 802 of the protrusions.

FIG. 9A shows another embodiment of a back panel 900 with an airflow system 902. The airflow system 902 again includes protrusions 904 extending outward, e.g., along the axis 156, from a base 906 of the back panel 900. However, in FIG. 9A the protrusions 904 are shaped as louvers having a curved profile with apices 908.

The protrusions 904 are arranged in a first column 910 and a second column 912 extending vertically down the back panel 900. The protrusions 904 in the first column 910 have offset apices 908 with regard to the lateral direction, e.g., axis 154. Likewise, the protrusions 904 in the second column 912 also have offset apices. Specifically, the apices 908 of the protrusions 904 in each column sequentially shift outward with regard to lateral sides of the panel 900 in an upper portion, with respect to the vertical axis 152, of the column and then shift inward in a lower portion of the panel 900. Offsetting the apices 908 of the louvers allows a desired airflow pattern with both vertical and lateral components to be generated which increases airflow throughput, when compared to previous back panels, as shown in FIGS. 1-8B. Furthermore, it will be appreciated that by offsetting the apices 908, the protrusions 904 vary in profile as well as size. In other examples, however, the apices of the protrusions may not be laterally offset or may have a different offset arrangement.

As shown, the protrusions 904 also taper in height, defined long the axis 156, and vertical width, defined along a plane formed by the axes 152 and 154, with regard to a laterally inward and outward direction. In this way, the area contacting the user's back may be reduced to increase airflow through the back panel 900. However, other contours of the protrusions have been envisioned.

The airflow system 902 also includes a vertical airflow channel 914 and lateral airflow channels 916. The airflow channels allow an airflow pattern to be generated, during use of the backpack, with both vertical and lateral components, to increase user cooling. In one specific example, the ratio of vertical to horizontal airflow channels may be selected to increase user cooling during use, such as 1:3, 1:4, 1:5, etc. It has been found through testing of the pack panel that the back panel may capture up to 16% of the wind speed traveling around the sides and back of the user, during use of the pack in certain scenarios.

FIG. 9B shows another view of the back panel 900. Again the protrusions 904 are shown arranged in the first column 910 and the second column 912. The vertical flow channel 914 and lateral flow channels 916 are again shown. Arrows 918 indicate the general direction of flow through the flow channels. As illustrated, the airflow pattern has both vertical and horizontal components, to provide cooling across a wider range of the panel as well as increase airflow during use of the pack.

FIG. 9C shows a backside of the back panel 900. As shown, the protrusions 904 include hollow interior cavities 920. However, semi or fully solid protrusions have been contemplated. The protrusions 904 may be constructed out of a polymeric material such as closed and/or open cell foams (e.g., EVA foams, PEVA foams, PU foams, rigid foams, syntactic foams, etc.,), polyethylene, PU, metal reinforcement structures, etc. In one example, the foam protrusion may have a specific gravity between 18-21 degrees. It will be appreciated that providing a foam having a specific gravity in this range may strike a desired balance between protrusion support and protrusion compliance. However, polymeric foams with alternate specific gravities have been contemplated.

Figure 10A:
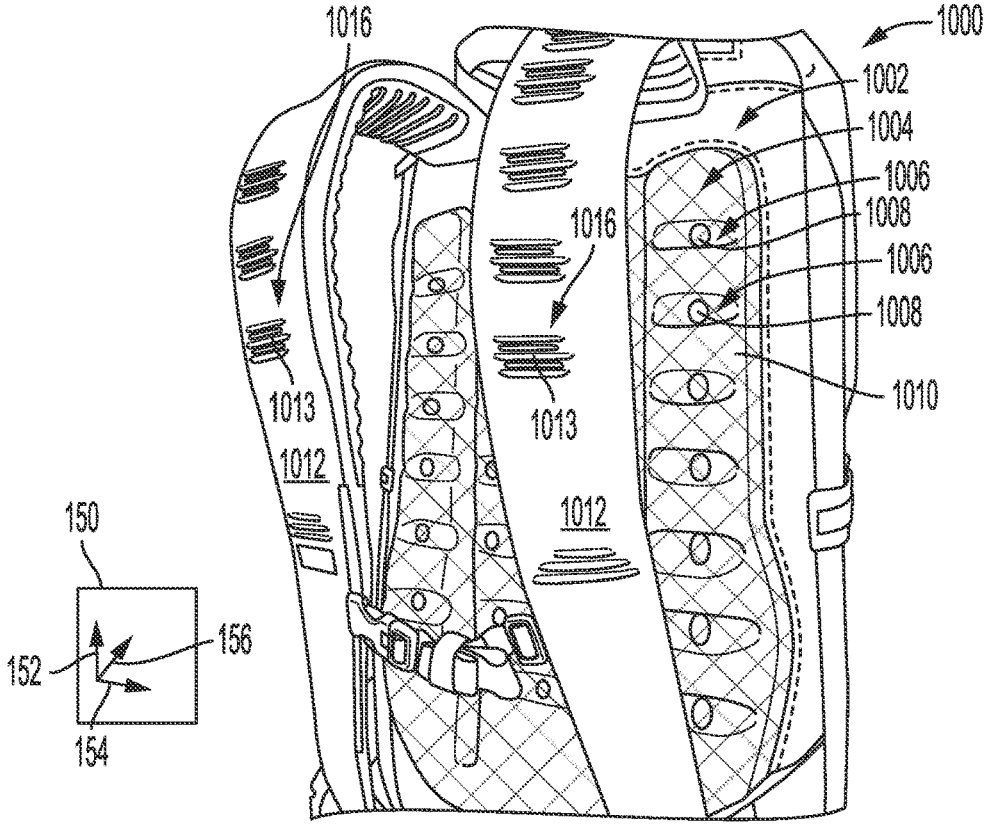
FIGS. 10A-10D show a fourth embodiment of a backpack with a back panel having an airflow system.

FIG. 10A shows another embodiment of a backpack 1000 having a back panel 1002 with an airflow system 1004. Again, the backpack 1000 may share common features with the other backpack embodiments described herein. As such, redundant description is omitted.

The airflow system 1004 shown in FIG. 10A includes curved recesses 1006 arranged in rows, along the axis 154, and columns, along the axis 152, to again provide lateral and vertical airflow components in the airflow pattern.

Each curved recess includes an opening 1008, in the illustrated example. However, in other examples, at least a portion of the recesses may not include openings. The airflow system 1004 includes a mesh layer 1010 extending across at least a portion of the back panel 1002, in the illustrated embodiment. However, in other embodiments the mesh layer may be omitted from the airflow system 1004. The mesh layer 1010 may decrease backpack slippage while allowing for increased breathability of the back panel 1002. As a result, the backpack is more likely to remain in a desired position during use while achieving desired thermal management characteristics. The mesh layer 1010 is shown attached to a section of the pack adjacent to an outer border of the back panel 1002. However, in other examples, the mesh layer 1010 may be directly attached to the back panel 1002.

The backpack 1000 illustrated in FIG. 10A, also includes shoulder straps 1012 configured with cooling features. The straps 1012 include lateral stabilization elements 1013 on front side 1016. The lateral stabilization elements 1013 are depicted laterally extending across a portion of the front side of the strap and are adapted to decrease flexion (e.g., torsional flexion) of the straps, during use.

Figure 10B:
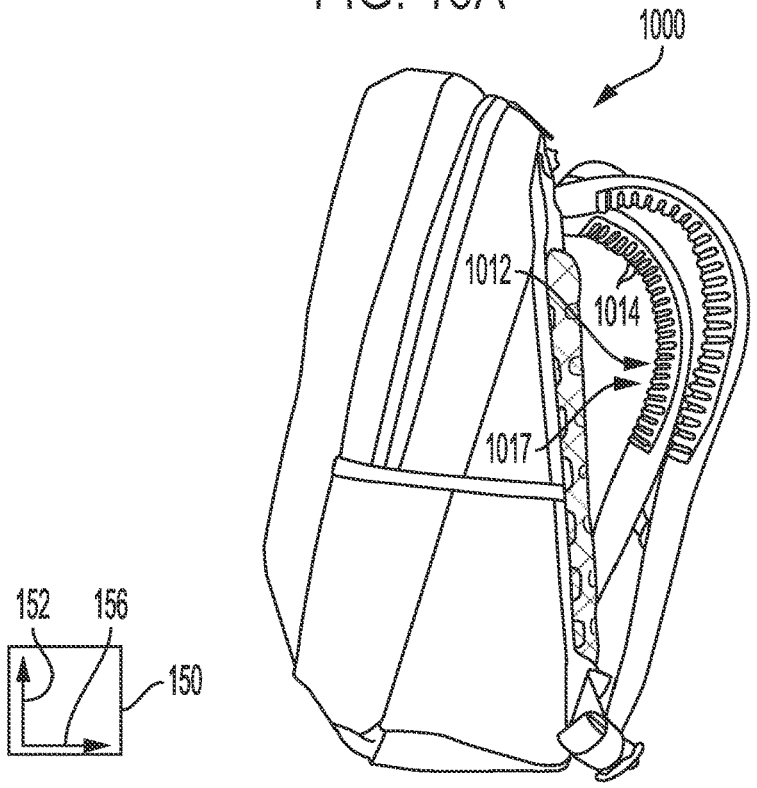

Additionally, as illustrated in FIG. 10B the straps 1012 in the backpack 1000 also include ridges 1014 on rear sides 1017 of the straps. The ridges 1014 reduce the contact area between the user's shoulder and the straps. In this way, the user may experience increased cooling when compared to flat strap designs. The ridges 1014 also reduce wrinkling of the straps, further improving the backpack's comfort. The ridges 1014 are equally spaced apart, in the illustrated example. However, in other examples, the spacing of the ridges may vary along the strap. Additionally, the ridges 1014 extend laterally, along the axis 154, across the straps 1012 and include a curved outer surface, in the depicted example. However, in other examples, the ridges may only extend across a portion of the straps and/or may include a planar outer surface.

Figure 10C:
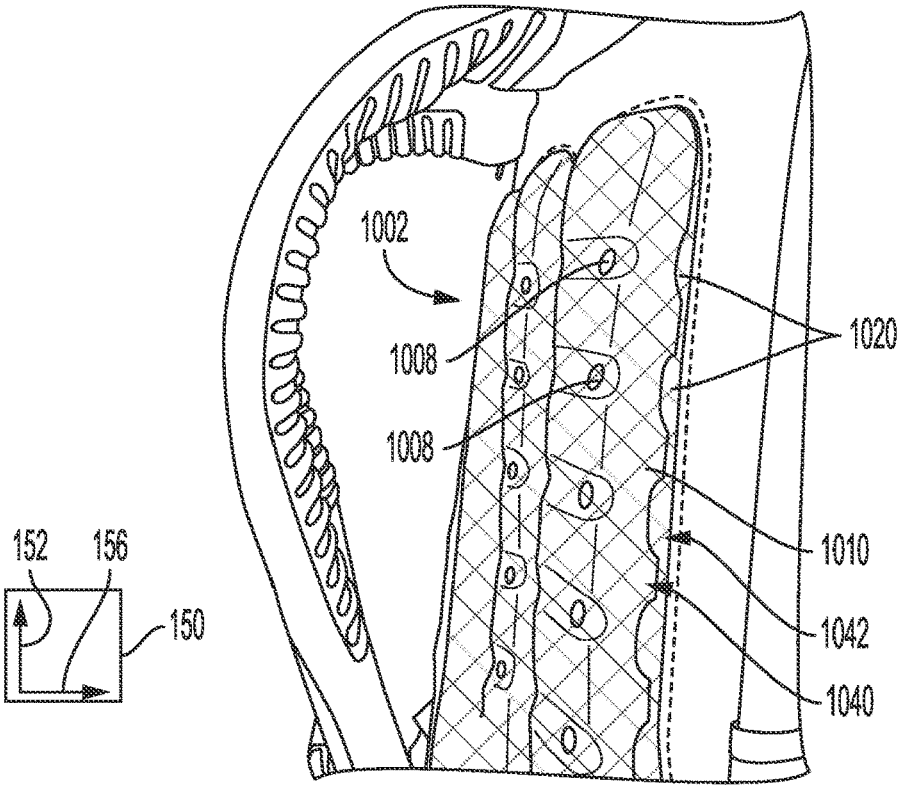

FIG. 10C depicts another view of the backpack 1000. The back panel 1002 is shown including lateral openings 1020 in fluidic communication with the openings 1008. The layer of mesh 1010 extends over the lateral openings 1020, in the illustrated example. However, the mesh may not extend over the lateral openings or only partially extend across the lateral openings, in other instances. The lateral openings 1020 allow lateral components of airflow traveling through the back panel 1002 to be increased, further increasing user cooling.

The openings 1008 may be arranged at an angle with regard to a longitudinal axis. For instance, the angle may be between 30-60 degrees. However, other angle ranges have been contemplated. In this way, air flowing through the openings 1008 may be laterally directed across the back panel to further increase the lateral component in the back panel's airflow. It will also be appreciated that in other examples, the angle of the openings 1008 with regard to the axis 156 may be varied along sequential openings in a vertical direction. For example, the uppermost opening may have an angle between 50-60 degrees, while the next opening may have an angle between 40-50 degrees.

FIG. 10C also shows the back panel 1002 having an outer section 1040 and a reinforcement section 1042. The outer section 1040 may be a raised, e.g., protruding along the axis 156 from the reinforcement section 1042, continuous structure with offset outer and inner airflow channels. In one example, the reinforcement section 1042 may be constructed out of a denser foam than the outer section 1040. For instance, bubble growth in a similar polymer may be controlled during manufacture of the outer section 1040 and the reinforcement section 1042 to achieve the varying densities. However, in other examples, the polymeric foams used to manufacture the outer section and the reinforcement section may differ. For example, the outer section may include EVA foam and the reinforcement section may include polyethylene (PE). However, numerous suitable polymer combinations have been contemplated. In this way, the reinforcement section 1042 serves to provide structural support to the backpack and the outer section 1040, which contacts the user's back, exhibits increased compliance to increase backpack comfort. However, other types of material construction of the different sections have been envisioned. It will also be appreciated that the lateral openings 1020 may be formed by the relative positioning of the reinforcement section 1042 and the outer section 1040.

Figure 10D:
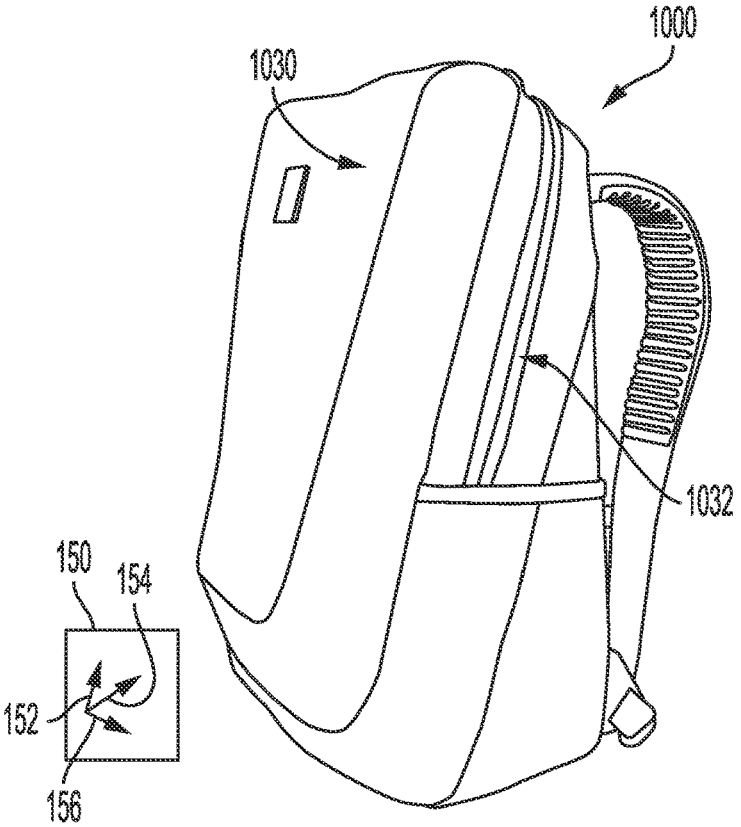

FIG. 10D shows another view of the backpack 1000 with a storage compartment 1030. The storage compartment may be positioned along an opposite side of the backpack 1000 from the back panel 1002. The storage compartment 1030 may be accessed via a zipper 1032. However, additional or alternative components for closing/opening the storage compartment have been contemplated such as buttons, clips, clasps, buckles, etc. Furthermore, other dimensions, shapes and configurations for closing/opening the storage compartment have been envisioned.

FIG. 11A shows another embodiment of a back panel 1150. It will be appreciated that the back panel 1150, shown in FIG. 11A, may be included in any of the backpack embodiments described herein. In one example, the back panel 1150 may be the back panel 1002 of FIGS. 10A-10C. The back panel 1150 includes an outer section 1100 and a base, or reinforcement section 1102 positioned interior to the outer section 1100. As described above, the outer section 1100 is a raised structure protruding outwards, along the axis 156, from the reinforcement section 1102.

The reinforcement section 1102 and the outer section 1100 may be constructed out of different materials, as previously discussed. The outer section 1100 includes a plurality of curved recesses 1152. The recesses 1152 have curved surfaces, e.g., having a semi-circular cross-section along the plane formed by the axes 154 and 156, to increase air flow velocity through the recesses 1152. The curved recesses 1152 are arranged in columns and rows. Specifically, in the illustrated example, there are four columns of recesses and seven rows.

Vertical flow channels 1106, extending parallel to the axis 152, are arranged between the columns. The vertical flow channels 1106 extend along at least a portion of a length 1103 of the back panel 1150. In one example, the vertical flow channels 1106 extend along at least half of the length 1103 of the back panel 1150 and may each have length that are similar or different. The vertical flow channels 1106 include one vertical flow channel aligned with a central axis 1101 of the back panel 1150 in a central region of the back panel 1150. The vertical flow channels 1106 extend down, along the axis 152, from a top 1164 of the back panel 1150.

As shown in FIG. 11B, the lateral alignment of the recesses 1152 form lateral outer flow channels 1107 extending entirely across a width 1111 of the back panel 1150, from a first external lateral edge 1160 to a second external lateral edge 1162. The outer section 1100 is formed exclusively of curved surfaces to direct and increase airflow across the lateral outer flow channels 1107 and through the vertical flow channels 1106. In this way, air may flow across the back panel 1150 between the protrusions 1104 and through the flow channels along two, perpendicularly oriented directions such that vertical and lateral flow components in the airflow are generated to cool the user.

The back panel 1150 of FIGS. 11A-11B includes three vertical flow channels 110 and seven lateral flow channels 1107. Other examples may include variations in quantities of the vertical and lateral flow channels (or any non-vertical flow channels) but a ratio of the lateral flow channels (and any non-vertical flow channels) to vertical flow channels may be maintained between 2.3:1 and 9:1. By maintaining the ratio within this range, maximum rates of airflow through the flow channels of the back panel 1150 may be enabled.

Sections 1104 (e.g., planar sections) extend vertically, e.g., along the axis 152 between adjacent recesses 1152 to provide an elevational variance, e.g., along the axis 156, in the panel which drives cooling in the back panel 1150. The sections 1104 may be protrusions 1104 that extend outward from the reinforcement section 1102 and therefore contact a user's back when in use. The arrangement of the recesses 1152 between the protrusions 1104 impart the outer section 1100 with an undulating profile, e.g., when viewed along the axis 154.

The recesses 1152 include circular apertures 1109 which are openings in the recesses 1152, similar to the openings 1008 shown in FIGS. 10A-10D. The circular apertures 1109 define flow paths through an interior of each of the protrusions 1104. Thus air may flow between the outer section 1100 and the reinforcement section 1102 through interior airflow passages of each of the protrusions 1104. The interior air flow passage of the protrusions 1104, extending along the axis 152, may intersect with lateral inner flow channels of the outer section 1100 of the back panel 1150.

The protrusions 1104 may have exterior lateral openings 1156, on a side of the protrusions 1104 proximate to a nearest external lateral edge of the outer section 1100, e.g., either of the first and second external lateral edges 1160, 1162. The protrusions may also have interior lateral openings 1108 on an opposite side of the protrusions 1104 from the exterior lateral openings 1156. The exterior and interior lateral openings 1156, 1108 of the protrusions 1104 define extreme define passages, or tunnels through each of the protrusions 1104 extending along the axis 154, enabling air outside of the protrusions 1104, e.g., external to, to be fluidically coupled to air inside the protrusions 1104. The tunnels of the protrusions 1104 may have semi-circular cross-sections, taken along the plane formed by the axes 152 and 156. As such, the protrusions 1104 may be hollow structures.

The alignment of the protrusions 1104 results in the tunnels of the protrusions 1104 to also be aligned along the axis 154. The aligned tunnels form lateral inner flow channels 1113 extending entirely across the width 1111 of the back panel 1150. The lateral inner flow channels 1113 are parallel with but offset from the lateral outer flow channels 1107. In other words, the lateral inner flow channels 1113 and the lateral outer flow channels 1107 are not reciprocal.

Air may be internally directed through the back panel, between the outer section 1100 and the reinforcement section 1102 through the lateral inner flow channels 1113 to increase user cooling. It will be appreciated that the cross-sectional shape of the lateral inner flow channels 1113 is a non-limiting examples. Other opening shapes have been contemplated such as ovals, squares, rectangles, etc. Furthermore, the exterior lateral openings 1156 are aligned with a longitudinal axis, e.g., the axis 152, in the illustrated example. However, other alignments of the exterior lateral openings 1156 have been considered, such as offset, curved, slanted, etc.

The outer section 1100 further includes lateral extensions 1112 extending between the columns at a bottom side 1114 of the back panel 1150. In this way, increased airflow may be directed through the lateral inner flow channels 1113. The lateral extensions 1112 also provide increased support across the back panel 1150. Cooling during backpack use is therefore increased which correspondingly increases backpack comfort. Edges 1116 of the outer section 1100 are curved to further increase comfort of the panel. However, in other examples, edges with less curvature may be used.

FIG. 11B illustrates the back panel 1150 with a mesh layer 1158 extending across the outer section 1100, e.g., covering the outer section 1100. As previously discussed, the mesh may reduce backpack slippage while promoting user cooling. The back panel 1150 is shown in FIG. 11B to be symmetric about a central axis 1101 of the back panel 1150, the central axis 1101 parallel with the axis 152. The outer section 1100 may extend along at least a portion of a length 1103 of the back panel 1150, e.g., a length of the reinforcement section 1102 which may be equal to at least half of the length 1103. In some examples, the outer section 1100 may extend between 50-90% of the length 1103 of the reinforcement section 1102.

FIG. 12 shows another embodiment of a backpack 1200 having a back panel 1202 with an airflow system 1204. Again, the backpack 1200 may share common features with the other backpack embodiments described herein. The backpack 1200 may be symmetric about a central axis 1201 of the back pack 1200. However, unlike the embodiments of FIGS. 1-11B, back panel 1202 may include protrusions 1205 formed of one or more trapezoidal protrusions and one or more triangular protrusions, such as trapezoidal protrusions 1206 and triangular protrusions 1208. For example, each of columns 1210 and 1212 includes two trapezoidal protrusions and one triangular protrusion. The protrusions 1205 may further include a lower central protrusion 1211, which may be a rectangular protrusion 1211 at a bottom of the outer section 1100 that is centered about the central axis 1201. The rectangular protrusion 1211 may be configured to contact a lower back of the user.

The protrusions 1205 may extend outward from a base section 1216 of the back panel 1202 where the protrusions 1205 may be formed of a less dense material than the base section 1216 so that the protrusions 1205 are more flexible and able to conform to contours of a user's back. In one example, the protrusions 1205 do not include internal air flow passages. However, in other examples, at least some of the protrusions 1205 may include internal air flow passages 1203 extending laterally (e.g., along the axis 154) through the protrusions and/or internal air flow passages 1205 extending vertically (e.g., along the axis 152) through the protrusions.

The protrusions 1205 may extend, along the central axis 1201, across at least a portion of a length 1207 of the back panel 1202. For example, the protrusions 1205 may extend along between 50-90% of the length 1207 of the back panel 1202. The length of the back panel 1202 may be equal to a portion of an overall length 1209 of the back pack 1200 which may be between 50-70% of the length 1209 of the back pack 1200.

Implementation of the trapezoidal protrusions 1206 and triangular protrusions 1208 and the rectangular protrusions 1211 may direct air flow along three directions through channels formed by gaps or spaces between the protrusions 1205. For example, air may flow along a first direction through a vertical channel 1220, parallel with the central axis 1201 of the backpack 1200 and extending through a central region of the back panel 1202. The vertical channel 1220 extends down, along the central axis 1201, from a top 1232 of the back panel 1202. A length 1230 of the vertical channel 1220 may be less than the length 1207 of the back panel 1202 due to interruption by the rectangular protrusion 1211. In some examples, as shown in FIG. 12, the vertical channel 1220 extend along a portion of the length 1207 of the back panel 1202 equal to at least half of the length 1207 of the back panel 1202.

Air may also flow along a second, lateral direction, parallel with the axis 154, through a lateral channel 1222 between the rectangular protrusion 1211 and the triangular protrusions 1208. In addition, air may flow along a third direction that is tilted with respect to the central axis 1201 by angle θ through angled channels 1224 on either side of the central axis 1201. The angled channels 1224 each extend from the vertical channel 1220 to lateral edges 1240 of the back panel 1202. Reciprocating angled channels 1224 on opposite sides of the vertical channel 1220 may be continuous with one another. As such, reciprocating pairs of angle channels 1224 may form V-shaped airflow channels extending entirely between the lateral edges 1240 of the back panel 1202. The angle θ may be 45 degrees, as shown in FIG. 12, but may be any angle between 0 to 90 degrees in other examples.

The use of trapezoidal and triangular protrusions may increase an airflow through airflow system 1204, and further may increase a stability of back panel 1202, which may correspondingly increase user comfort. As an example, the triangular protrusions 1206 may prevent back panel 1202 from bending along one or more axes. As another example, the trapezoidal protrusions 1206 may provide a different airflow pattern and/or speed through the back panel 1202, relative to the airflow through other back panels shown, such as back panel 402 of FIG. 4, for example. In other examples, each of columns 1210 and 1212 may include more than one trapezoidal protrusion, and may further include protrusions of other shapes suitable to promote flow through airflow system 1204 and back panel stability. Furthermore, other examples may include different quantities and different ordering of trapezoidal and triangular protrusions along columns 1210 and 1212.

It will be appreciated that the backpack 1200 shown in FIG. 12 is a non-limiting example. Other examples may include different quantities of each type of protrusions, as described above, different dimensions of the protrusions and arrangement of the protrusions to create airflow channels directing flow along more or less than three directions.

While the embodiments of a backpack shown in FIGS. 1-12 depict various configurations of protrusions and airflow channels disposed between preformed protrusions of a back panel of the backpack, the embodiments share common elements. For example, lateral airflow channels of the back panels may extend between a vertical airflow channel in a central region of the back panel to a lateral edge of the back panel, therefore allowing air to flow freely between edges of the back panel and the central region of the back panel. Each embodiment has the centrally disposed vertical airflow channel extending along at least a portion of a length of the back panel from a top of the back panel, the portion of the length is at least half of the length.

The centrally disposed vertical airflow channel may be a main flow passage along the back panel configured with a plurality of air junctions branching from the main flow passage. The air junctions may be formed from the non-vertically oriented airflow channels that intersect with the main flow passage providing alternate flow routes along at least two directions away from the main flow passage. In some examples, the vertical main flow passage may have a greater width, thereby flowing a greater volume of air than the branching non-vertically oriented airflow channels, as shown in FIGS. 1-11D.

In this way, a backpack may be configured with increased air flow between the backpack and a wearer's torso by equipping a back panel of the backpack with protrusions guiding air flow through channels formed by the protrusions. The protrusions may have a variety of shapes and orientations in order to achieve a desired flow of air to provide increased convective and evaporative cooling to the wearer. As such, market appeal of the backpack and customer satisfaction is enhanced.

FIGS. 2-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

The invention will be further described in the following paragraphs. In in an embodiment, a backpack is provided that comprises: a storage compartment; and a back panel coupled to the storage compartment and comprising an airflow system including: a plurality of protrusions extending outward from a base of the back panel; a plurality of air channels positioned between the plurality of preformed protrusions and configured to direct airflow along at least two directions through the back panel, wherein one air channel of the plurality of air channels is positioned in a central region of the back panel and extends down from a top of the back panel to at least halfway along a length of the back panel, parallel with the central axis.

In a first example of the backpack, a first set of air channels of the plurality of air channels extends between the columns and direct airflow along a direction parallel with the central axis through the back panel, the first set of air channels including the air channel positioned in the central region of the back panel. In a second example of the backpack optionally including the first example, a second set of air channels of the plurality of air channels extends between the plurality of preformed protrusions along a direction perpendicular to the central axis and wherein the first and second sets of air channels each include one or more air channels. In a third example of the backpack optionally including one or more of the first and second examples, the plurality of preformed protrusions is formed of a first material with a lower density than a material forming the base of the back panel. In a fourth example of the backpack optionally including one or more of the first through third examples, the back panel is symmetric about the central axis. In a fifth example of the backpack optionally including one or more of the first through fourth examples, the plurality of preformed protrusions is arranged in two or more columns extending at least along half of a length of the back panel, the length parallel with the central axis.

In another embodiment, a backpack comprises: a storage compartment; and a back panel coupled to the storage compartment and including an airflow system with a raised outer section having a set of inner airflow channels offset from a set of outer airflow channels.

In a first example of the backpack, the airflow system further includes a reinforcement section positioned interior of the outer section and the outer section is a continuous structure protruding outwards from the reinforcement section. In a second example of the backpack optionally including the first example, the reinforcement section is constructed out of a first foam having a greater density than a second foam used to construct the outer section. In a third example of the backpack optionally including one or more of the first and second examples, the outer airflow channels are formed from recesses in an outer surface of the outer section, the recesses aligned along a lateral axis of the backpack and wherein the outer airflow channels extend from a first lateral edge of the back panel to a second lateral edge. In a fourth example optionally including one or more of the first through third examples, the protrusions are positioned between the recesses, the protrusions extending outward from the back panel, and the protrusions and recesses are arranged in a plurality of columns extending along a longitudinal axis of the back panel. In a fifth example optionally including one or more of the first through fourth examples, the protrusions are hollow structures enclosing interior airflow passages extending through the protrusions along the lateral axis and wherein the inner airflow channels of the outer section are formed by alignment of the protrusions along the lateral axis. In a sixth example optionally including one or more of the first through fifth examples, the protrusions have openings at extreme ends of the protrusions, along the lateral axis, fluidically coupling air inside the protrusions to air outside of the protrusions. In a seventh example optionally including one or more of the first through sixth examples, the inner airflow channels extend from the first lateral edge of the back panel to the second lateral edge of the back panel, parallel with the outer airflow channels. In an eighth example optionally including one or more of the first through seventh examples, air flows between the outer section and the reinforcement section of the back panel through the inner airflow channels. In a ninth example optionally including one or more of the first through eighth examples, the backpack further comprises vertical airflow channels extending through the outer section of the back panel parallel with the longitudinal axis, the vertical airflow channels including one airflow channel positioned in a central region of the back panel and extending from a top of the back panel to a least halfway along a length of the back panel. In a tenth example optionally including one or more of the first through ninth examples, the outer section has an undulating profile.

In yet another embodiment, a backpack comprises: a storage compartment; and a back panel coupled to the storage compartment, the back panel having protrusions of different shapes, the protrusions defining airflow channels including: a first set of airflow channels extending longitudinally across the back panel, from a top of the back panel to at least a mid-point of a length of the back panel; a second set of air flow channels extending laterally across the back panel, from a first lateral edge to a second lateral edge of the back panel and intersecting with the first set of airflow channels; and a third set of air flow channels forming a V-shape across the back panel, from the first lateral edge to the second lateral edge of the back panel and intersecting with the first set of airflow channels.

In a first example of the backpack, the protrusions include trapezoidal, triangular and rectangular shapes. In a second example of the backpack optionally including the first example, the first set of airflow channels includes one airflow channel extending along a central region of the back panel, between the top of the back panel and one of the protrusions positioned at a bottom of the back panel.

The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A backpack, comprising;

a storage compartment; and a back panel coupled to the storage compartment, the back panel having protrusions of different shapes, the protrusions defining airflow directions including:

a first airflow direction extending longitudinally across the back panel, from a top of the back panel to at least a mid-point of a length of the back panel;

a second air flow direction extending laterally across the back panel, from a first lateral edge to a second lateral edge of the back panel and intersecting with the first airflow direction; and a third air flow direction forming a V-shape across the back panel, from the first lateral edge to the second lateral edge of the back panel and intersecting with the first airflow direction;

wherein the first airflow direction terminates at a lower central protrusion of the protrusions, the lower central protrusion positioned at a bottom of the back panel and centered about a central axis of the back panel; and wherein an area of a first apex of a first V-shaped channel of the third air flow direction is smaller than an area of a second apex of a second V-shaped channel of the third air flow direction, the second V-shaped channel positioned below the first V-shaped channel.

2. The backpack of claim 1, wherein the protrusions include trapezoidal, triangular and rectangular shapes.

3. The backpack of claim 1, wherein the first airflow direction includes one airflow channel extending along a central region of the back panel, between the top of the back panel and the lower central protrusion.

4. The backpack of claim 1, wherein one or more of the protrusions includes interior flow passages extending between openings in lateral sides of the protrusions.

5. The backpack of claim 1, wherein one or more of the protrusions includes interior flow passages extending between openings in longitudinal sides of the protrusions.

6. The backpack of claim 1, wherein one or more of the protrusions includes both interior flow passages extending between openings in lateral sides of the protrusions and interior flow passages extending between openings in longitudinal sides of the protrusions.

7. The backpack of claim 1, wherein the lower central protrusion is configured to contact a lower back of a user.

8. The backpack of claim 1, wherein the protrusions are formed of a less dense material than a base section of the backpack, and wherein the protrusions protrude from the base section.

9. The backpack of claim 8, wherein the base section of the backpack extends up to 70% of a length of the backpack.

10. The backpack of claim 8, wherein the protrusions extend along the central axis between 50%-90% of a length of the base section of the backpack.

11. The backpack of claim 1, wherein reciprocating pairs of channels of the third airflow direction are angled relative to the central axis by between 10 to 80 degrees.

12. The backpack of claim 1, wherein reciprocating pairs of channels of the third airflow direction are angled relative to the central axis by 45 degrees.

13. A panel for a backpack, comprising:

an arrangement of a plurality of protrusions with different geometries and configured with interior airflow channels extending between lateral sides and/or longitudinal sides of each of the plurality of protrusions, the arrangement of the plurality of protrusions forming:

a first airflow direction extending longitudinally across the panel, from a top of the panel to at least a mid-point of a length of the panel;

a second air flow direction extending laterally across the panel, from a first lateral edge to a second lateral edge of the panel and intersecting with the first airflow direction; and a third air flow direction forming a V-shape across the panel, from the first lateral edge to the second lateral edge of the panel and intersecting with the first airflow direction, wherein V-shaped air flow channels of the third air flow direction taper in width away from an apex of a respective V-shaped air flow channel, the width defined along a central axis of the panel;

wherein a central airflow channel of the first set of airflow channels terminates at a lower central protrusion of the plurality of protrusions, the lower central protrusion positioned at a bottom of the panel and centered about a central axis of the panel; and wherein an area of a first apex of a first V-shaped air flow channel of the third air flow direction is smaller than an area of a second apex of a second V-shaped air flow channel of the third air flow direction, the second V-shaped air flow channel positioned below the first V-shaped air flow channel.

14. The panel of claim 13, wherein the arrangement of the plurality of protrusions includes arranging a portion of the plurality of protrusions spaced apart from one another and in two columns.

* * * * *